US005139915A

United States Patent [19]

Moffat et al.

[11] Patent Number: 5,139,915

[45] Date of Patent: Aug. 18, 1992

[54] ENCAPSULATED TONERS AND PROCESSES THEREOF

[75] Inventors: Karen A. Moffat, Brantford; Walter Mychajlowskij, Georgetown; Anthony J. Paine, Mississauga, all of Canada; Bing R. Hsieh, Webster, N.Y.

[73] Assignee: Xerox Corporation, Stamford, Conn.

[21] Appl. No.: 516,864

[22] Filed: Apr. 30, 1990

[51] Int. Cl.[5] ..... G03G 9/093

[52] U.S. Cl. ..... 430/110; 430/124; 430/137; 430/138

[58] Field of Search ..... 430/109, 110, 137, 138

[56] References Cited

U.S. PATENT DOCUMENTS

| | | | |
|---|---|---|---|
| 4,093,791 | 6/1978 | Bauer et al. | 526/200 |
| 4,193,889 | 3/1980 | Baatz et al. | 252/316 |
| 4,622,267 | 11/1986 | Riecke | 428/402.21 |
| 4,721,651 | 1/1988 | Riecke | 428/402.21 |
| 4,738,898 | 4/1988 | Vivant | 428/402.21 |
| 4,766,051 | 8/1988 | Breton et al. | 430/138 |
| 4,803,144 | 2/1989 | Hosoi | 430/106.6 |
| 4,937,167 | 6/1990 | Moffat et al. | 430/138 X |
| 4,968,577 | 11/1990 | Kohri et al. | 430/138 X |
| 4,977,052 | 12/1990 | Mikami | 430/138 X |
| 5,013,630 | 5/1991 | Ong et al. | 430/138 |

*Primary Examiner*—Roland Martin
*Attorney, Agent, or Firm*—E. O. Palazzo

[57] ABSTRACT

An encapsulated toner composition comprised of a core comprised of a monomer, or monomers which are subsequently polymerized; pigment or dye particles; an emulsifier component selected from the group consisting of organic methyl cellulose and hydroxylated methyl cellulose components into which the pigmented monomer mixture is dispersed, and wherein the core is encapsulated within a polymeric shell.

73 Claims, No Drawings

ENCAPSULATED TONERS AND PROCESSES THEREOF

BACKGROUND OF THE INVENTION

The present invention is generally directed to toner compositions, and more specifically to encapsulated colored heat fusible toner compositions. In one embodiment, the present invention is related to low melting encapsulated colored toner compositions comprised of a core with a polymeric shell thereover preferably prepared by interfacial polymerization. Another specific embodiment of the present invention relates to encapsulated colored toner compositions comprised of a core containing a preformed polymer and/or monomers, a free radical initiator which initiates the free radical polymerization of the core monomers when heated, pigment dye particles, or mixtures thereof, and wherein the core is dispersed into an emulsifier solution, and subsequently encapsulated by a polymeric shell followed by core polymerization at elevated temperatures via free radical polymerization with the emulsifier or surfactant being comprised of organic methyl cellulose, hydroxylatedmethyl cellulose components, such as Tylose available from Fluka Inc. of Canada, or Methocel available from Dow Chemical, or mixtures thereof. In another embodiment of the present invention there may be selected as the emulsifier or surfactant the aforementioned emulsifiers with other emulsifiers such as poly(vinyl alcohol). Several advantages are associated with the encapsulated toners of the present invention including their desirable heat fusibility, triboelectric passivation of the components, especially the pigment components present in the core thereby avoiding or minimizing the electrical, especially the triboelectrical, degradation properties of the resulting toner caused by the pigment particles; narrow size distribution of the particles (GSD) of, for example, from 1.5 to about 1.8; stable shell characteristics, dissolvable blocking temperatures, for example in an embodiment of the present invention blocking temperatures for the heat fusible toners, especially with polyurea shells, of greater than 80° C.; avoidance or minimization of particle agglomeration and coalescence, especially at elevated core polymerization temperatures; excellent melt flow properties, for example from about 10° to about 20° C. lower than a toner comprised of styrene n-butylmethacrylate, 88 weight percent, 10 weight percent of carbon black, and 2 weight percent of cetyl pyridinium chloride as a charge enhancing additive, and the like. In another embodiment of the present invention, there can be included in the encapsulated toner compositions optional surfactants such as anionic, cationic as well as ambithillic and nonionic materials. Particularly useful as surfactants are fluorinated hydrocarbons such as fluoride FC-170C. available from 3M; Zonyl FSA available from E.I. DuPont, and Zonyl FSN available from E.I. DuPont, which surfactants may, in an embodiment of the present invention, be utilized in combination with surfactants such as polyvinyl alcohol.

Toners suitable for use in electrophotographic apparatuses, including printers, may include therein a wide variety of colors, such as black, red, green, blue, brown, yellow, purple, silver and gold. When it is desired to highlight certain features of a document, one or more colored toners are typically used in conjunction with a black toner to provide an image in two or more colors. Full color images can also be generated by developing images with cyan, magenta, yellow and black toners. Generally, it is advantageous for such toners to exhibit low melting temperatures to enable low energy fusing of the developed images to substrates at lower temperatures and lower pressures of 400 psi versus 4,000 psi for many prior art cold pressure fixable applications. It is also often advantageous for such toners to possess mean particle diameters of from about 5 microns to about 35 microns and preferably from about 5 microns to about 15 microns to enable images of high resolution, low image noise and high color fidelity. Further, it is generally desirable for these small diameter toners to possess very narrow size distributions, preferably with a GSD (Geometric Standard Deviation) of 1.3 or less, to avoid difficulties in the electrophotographic development and transfer associated with oversize toner particles and extremely fine toner particles. These and other advantages can be achieved with the encapsulated toners and processes of the present invention in embodiments thereof. More specifically, an advantage associated with the toners of the present invention in an embodiment thereof is the enablement of preparing both heat fusible low Tg (<130° C.) shell and low Tg (<55° C.) core compositions comprised of a styrene/stearyl methacylate core with pigment and emulsifier and metatetramethylxylene diisocyanate (m-TMXDI) and 1,3-cyclohexanebis(methylamine) CHBMA shell which provides melt flow properties 10° to 20° C. lower than a toner comprised of resin particles, such as stryen/n-butyl methacrylate copolymer, carbon black, and the charge enhancing additive cetyl pyridinium chloride. Also, with a shell of metatetramethylxylene diisocyanate (m-TMXDI) and 2-methylpentamethylenediamine (Dytek A) and with the aforementioned core components there are enabled improvements in heat fusibility of the particles by permitting softening and/or melting of the shell during the fusing process. In an embodiment of the present invention, the incorporation into the toner core of Tylose 93800, a hydroxyethylmethyl cellulose or other emulsifier as illustrated herein is advantageous since, for example, it enables a narrower GSD value for the particles, which is determined at the dispersion step, of from 1.6 to 1.35 especially for colored heat fusible toners, and also the Tylose is an excellent dispersing agent at elevated temperatures such as 85° C. during the free radical polymerization step, thus an additional dispersant component such as Daxad is not required to prevent particle agglomeration and coalescence even with low Tg shells. Another advantage of using Tylose as the emulsifier is that when incorporated into the shell, it does not usually adversely affect the melt flow properties of the toner particles and thus does not substantially increase the fusing temperature of the toner as is the situation with a poly(vinylalcohol) emulsifier. Improved toner compositions have also been prepared by incorporating polyether backbone prepolymers and the like into the heat fusible shell to improve shell flexibility and overall fusibility of the toner. The blocking temperatures of the particles prepared with both a heat fusible shell and core wherein, for example, Tylose is present as an emulsifier is equal to or greater than 80° C. in an embodiment of the present invention. With the incorporation of Tylose or other similar emulsifier as illustrated herein, pigment passivation is accomplished. Also, with the emulsifiers illustrated herein, especially Tylose, the toner particle size and distribution can be improved resulting in a narrow tribo range when charged, for example, against different carriers.

The toner compositions of the present invention can be selected for a variety of known imaging and printing processes including electrophotographic processes. Specifically, the toner compositions of the present invention can be selected for xerographic imaging and printing processes including color processes, such as two component development systems and single component development systems, including both magnetic and nonmagnetic; and ionographic processes wherein dielectric receivers such as silicon carbide are utilized, reference U.S. Pat. No. 4,885,220, the disclosure of which is totally incorporated herein by reference.

In a patentability search report, there were recited as prior art the following U.S. Pat. Nos. 4,830,144 directed to encapsulated pressure fixable toners with an electroconductive powder coating, reference, the Abstract of the Disclosure, and the disclosure beginning in column 3, around line 48. Examples of shell components are illustrated in column 4, beginning at around line 33, and note specifically the disclosure in column 4, beginning at line 47, wherein shells are produced by the polycondensation reaction between polyisocyanates and one or more of the counterpart compounds such as polyol, polythio, polyamine, water, and perpazine can be selected; the preparation of the encapsulated toner of this patent is illustrated in column 7, beginning at line 6; examples of colorants included in the core, which colorants may comprise dyes, pigments, and the like, are illustrated beginning in column 8; surface active agents selected for the encapsulated toner of the '144 patent are illustrated in column 11, while examples of the electroconductive material include components such as antimony, halogen, and the like, reference Claim 1, for example; U.S. Pat. No. 4,721,651 directed to microcapsules of the type selected for pressure sensitive carbonless copy papers with walls formed of an aliphatic diisocyanate and a diamine and containing, for example, a solvent mixture with a dye precursor dissolved therein, note for example the disclosure beginning in column 2, the working Examples, and Claim 1; a similar teaching is present in U.S. Pat. No. 4,622,267; U.S. Pat. No. 4,738,898 directed to microencapsulation by interfacial polyaddition of, for example, an aliphatic diisocyanate and an isocyanurate triamer, and wherein the aforementioned components can be interfacially reacted with a polyamine; the selection of carboxy methylcellulose, sodium salt, is illustrated in the working Examples, reference working Example 1, column 5, beginning at line 26; further, note the disclosure in column 3, beginning at line 46, wherein it is indicated that it is envisioned, for example, to encapsulate plant protection agents such as herbicides, fungicides, or insecticides, which makes then less hazardous to handle, and it is also intended to encapsulate the pharmaceutical products, food products, flavors, perfumes, colorants, paints, or catalysts, reference the disclosure in column 3, beginning at line 46; U.S. Pat. No. 4,766,051, the disclosure of which is totally incorporated herein by reference, directed to colored encapsulated toner compositions, more specifically, cold pressure fixable colored toner compositions comprised of a core containing a polymer in which is dispersed pigment particles selected from the group consisting of cyan, magenta, red, yellow pigments, and mixtures thereof, and magnetites encapsulated within a polymeric shell formulated by an interfacial polymerization, note specifically, for example, the disclosure in column 3, beginning at line 35, and continuing on to column 15, and note that polyvinyl alcohol may be selected, and more specifically, for example, the organic phase can be dispersed by a polytron in an aqueous phase containing polyvinyl alcohol to obtain toner particles, see column 6, beginning at line 28, and note specifically the working Examples, especially working Example 11; and U.S. Pat. No. 4,193,889 directed to microencapsulation with modified polyisocyanates, and more specifically to microcapsules and a process therof, the walls of which consist of polycondensates of a film forming aliphatic polyisocyanate containing at least one biurett group or polyaddition products thereof with a chain extending agent, reference the Abstract of the Disclosure; and note the disclosure in columns 2, 3 and 4.

In a copending application directed to encapsulated toner, there were mentioned in a patentability search report the following U.S. Pat. Nos. 4,727,101, the disclosure of which is totally incorporated herein by reference, which illustrates a free radical polymerization of a toner shell at elevated temperatures and more specifically is directed to the preparation of encapsulated toner compositions, which comprises mixing in the absence of a solvent a core monomer, initiator, pigment particles, a first shell monomer, stabilizer, and water, and thereafter adding a second shell monomer to enable interfacial polymerization interaction, and subsequently affecting the free radical polymerization of the core monomer, reference the Abstract of the Disclosure for example; U.S. Pat. No. 4,777,104 the disclosure of which is totally incorporated herein by reference, which relates to processes for the formation of electrophotographic toners of certain desired sizes by radical polymerization, reference for example column 3, lines 26 to 41, and also note the disclosure in column 6 with respect to colorants, beginning at line 29; U.S. Pat. No. 4,524,199, the disclosure of which is totally incorporated herein by reference, which relates to stable polymeric dispersions, which dispersion comprises, for example, a polar dispersion medium having dispersed therein particles comprising a thermoplastic resin core having irreversibly anchored thereto a nonionic amphipathic steric stabilizer comprising a graft copolymer, reference for example column 2, beginning at line 45, and note column 4, beginning at line 57, and continuing on to column 5; U.S. Pat. No. 4,533,617 the disclosure of which is totally incorporated herein by reference, directed to heat fixable developers with a capsule structure containing a binder resin of a certain glass transition temperature and a colorant coated with a vinyl type polymer, reference for example the Abstract of the Disclosure, and note columns 4 through 10; U.S. Pat. No. 4,725,522 directed to processes for cold pressure fixable encapsulated toner compositions, particularly processes thereof wherein a water phase containing a stabilizing material is selected and hydrolysis is accomplished by heating and there is utilized interfacial polymerization to form the shell, reference for example the Abstract of the Disclosure, and also note columns 4 to 8, the disclosure of the aforementioned patent being totally incorporated herein by reference; U.S. Pat. No. 3,876,610 relating to the preparation of electrostatic toner materials with a size between 1 to 10 microns and containing a polymeric shell comprising a copolymer with a glass transition temperature of at least 40° C., see the Abstract of the Disclosure for example, the disclosure of the aforementioned patent being totally incorporated herein by reference; and U.S. Pat. No. 4,762,752 which discloses additional compounds suitable as dispersing agents, reference the Abstract of the Disclosure, for example the disclosure of the aforementioned patent being totally incorporated herein by reference.

Additionally, there is illustrated in U.S. Pat. No. 4,565,764 a pressure fixable microcapsule toner having a colored core material coated successively with a first resin wall and a second resin wall. The first resin wall has affinity to both the core material and the second resin wall. This patent teaches that the first resin wall may be of a material that becomes charged to a polarity opposite to that of the second resin wall and the core material.

Also, U.S. Pat. No. 4,520,091, the disclosure of which is totally incorporated herein by reference, illustrates a pressure fixable encapsulated electrostatographic toner material. The core comprises a colorant, a polymer, a solvent capable of dissolving the polymer or causing the polymer to swell, and an organic liquid incapable of dissolving the polymer or causing the polymer to swell, while the shell may consist of a polyamide resin. Preparation of the toner material is completed by interfacial polymerization.

Another patent, U.S. Pat. No. 4,708,924, the disclosure of which is totally incorporated herein by reference, describes a pressure fixable microcapsule type toner composed of a core material and an outer wall covering over the core material. The core material contains at least a combination of a substance having a glass transition point within the range of −90° C. to 5° C. with a substance having a softening point within the range of 25° C. to 180° C. This toner composition may comprise substances, such as polystyrene and poly(n-butylmethacrylate), and their copolymers.

Further, U.S. Pat. No. 4,254,201, the disclosure of which is totally incorporated herein by reference, illustrates a pressure sensitive adhesive toner consisting essentially of porous aggregates. Each aggregate consists essentially of a cluster of a multiplicity of individual granules of pressure sensitive adhesive substance, each granule being encapsulated by a coating film of a film-forming material. Particles of an inorganic or organic pigment and/or a magnetic substance are contained within the aggregate in the interstices between the granules and deposited on the surface of the encapsulated granules. The adhesive substance is selected from a copolymer of at least one monomer and as many as three other monomers.

In addition, U.S. Pat. No. 4,702,988, the disclosure of which is totally incorporated herein by reference, illustrates a process for the preparation of encapsulated toner. A monomer composition and a colorant are dispersed in a liquid dispersion medium in the presence of a solid fine powdery dispersion stabilizer. The liquid is pressurized and then ejected into a low pressure section to form particles of monomer composition. These particles are then subjected to suspension polymerization to produce toner particles.

In U.S. Pat. No. 4,727,011 there is disclosed a process for preparing encapsulated toner compositions, which comprises mixing, in the absence of a solvent, a core monomer, an initiator, pigment particles, a first shell monomer, stabilizer, and water; thereafter adding a second shell monomer, thereby enabling an interfacial polymerization reaction between the first and second shell monomers; and subsequently effecting a free radical polymerization of the core monomer. The disclosure of this patent is totally incorporated herein by reference.

Also, U.S. Pat. No. 4,855,209, the disclosure of which is totally incorporated herein by reference, discloses an encapsulated toner composition with a melting temperature of from about 65° C. to about 140° C. which comprises a core containing a polymer selected from the group consisting of polyethylene succinate, polyhalogenated olefins, poly(α-alkystyrenes), rosin modified maleic resins, aliphatic hydrocarbon resins, poly(ε-caprolactones), and mixtures thereof; and pigment particles, where the core is encapsulated in a shell prepared by interfacial polymerization reactions. The disclosure of this copending application is totally incorporated herein by reference containing a stabilizing material, hydrolyzing by heating the resulting mixture, subsequently effecting an interfacial polymerization of the mixture, and thereafter optionally washing the resulting toner composition.

There are disclosed in U.S. Pat. No. 4,307,169, the disclosure of which is totally incorporated herein by reference, microcapsular electrostatic marking particles containing a pressure fixable core, and an encapsulating substance comprised of a pressure rupturable shell, wherein the shell is formed by an interfacial polymerization. One shell prepared in accordance with the teachings of this patent is a polyamide obtained by interfacial polymerization. Furthermore, there is disclosed in U.S. Pat. No. 4,407,922, the disclosure of which is totally incorporated herein by reference, pressure sensitive toner compositions comprised of a blend of two immiscible polymers selected from the group consisting of certain polymers as a hard component, and polyoctyldecylvinylether-co-maleic anhydride as a soft component. Interfacial polymerization processes are also selected for the preparation of the toners of this patent. Also, there are disclosed in the prior art encapsulated toner compositions containing costly pigments and dyes, reference for example the color photocapsule toners of U.S. Pat. Nos. 4,399,209; 4,482,624; 4,483,912 and 4,397,483.

Copending application U.S. Ser. No. 043,265 (now abandoned) the disclosure of which is totally incorporated herein by reference, discloses an encapsulated composition suitable for use as an electrophotographic toner, which comprises a core encapsulated within a thermotropic liquid crystalline polymeric shell. On page 8 of this application, the specification indicates that the disclosed developer compositions can be charged to preselected values irrespective of the pigment selected for the core.

Further, U.S. Pat. No. 4,851,318 discloses an improved process for preparing encapsulated toner compositions which comprises mixing core monomers, an initiator, pigment particles, and oil soluble shell monomers, homogenizing the mixture into an aqueous surfactant solution to result in an oil-in-water suspension enabling an interfacial polymerization reaction between the oil soluble and the water soluble shell monomers, subsequently adding a low molecular weight polyethylene oxide surfactant protective colloid, and thereafter effecting free radical polymerization of the core monomers by heating. The disclosure of this U.S. Pat. No. 4,851,318 is totally incorporated herein by reference.

Moreover, illustrated in U.S. Pat. No. 4,758,506, the disclosure of which is totally incorporated herein by reference, are single component cold pressure fixable toner compositions, wherein the shell selected can be prepared by an interfacial polymerization process.

There is illustrated in a U.S. Pat. No. 4,937,167, the disclosure of which is totally incorporated herein by reference, a process for controlling the electrical characteristics of colored toner particles. The process comprises preparing a first core material comprising first pigment particles, core monomers, a free radical initiator, and optional polymer components, said second pigment particles being of a different color from that of the first pigment particles; encapsulating separately the first core material and the second core material within polymeric shells by means of interfacial polymerization reactions between at least two shell monomers, of which at least one is soluble in aqueous media and at least one of which is soluble in organic media, wherein the polymeric shell encapsulating the first core material is of substantially the same composition as the polymeric shell encapsulating the second core material; and subsequently polymerizing the first and second core monomers via free radical polymerization thereby producing two encapsulated heat fusible toner compositions of different colors with similar triboelectric charging characteristics.

There is also illustrated in U.S. Pat. No. 5,035,970, the disclosure of which is totally incorporated herein by reference, an encapsulated toner composition comprised of a core comprised of pigments or dyes, and a polymer; and wherein the core is encapsulated in a polyester shell with functional groups thereon, and derived from diacid halide polyesters.

U.S. Pat. No. 5,037,716, the disclosure of which is totally incorporated herein by reference, illustrates encapsulated toners with a Daxad dispersant. To stabilize heat fusible particles at elevated temperatures, the addition of a Daxad dispersant is required to prevent particle agglomeration and coalescence. The encapsulated toner composition comprises a core comprised of a preformer polymer and/or monomer or monomers, a free radical initiator, pigment or dye particles where the core is dispersed in an emulsifier solution, and subsequently encapsulated in a polymeric shell and wherein the toner is stabilized by Daxad dispersants during core polymerization, where the dispersant is a naphthalene sulfonate formaldehyde condensate material. In this patent application, the system emulsifier was not able to lower the GSD below 1.5 without classification. The incorporation of Daxad can be added after the particle generation step, thus Daxad has no effect on narrowing the GSD down to the desired value of 1.3.

Free radical polymerization is well known art, and can be generalized as bulk, solution, emulsion or suspension polymerization. These polymerizations are commonly selected for the preparation of certain polymers. The kinetics and mechanisms for free radical polymerization of monomer(s) is also well known. In these processes, the control of polymer properties such as molecular weight and molecular weight dispersity can be effected by initiator, species concentrations, temperatures, and temperature profiles. Similarly, conversion of monomer is effected by the above variables.

There is a need for encapsulated toner compositions with many of the advantages illustrated herein. More specifically, there is a need for encapsulated toners wherein particle agglomeration is eliminated or minimized. Another need resides in obtaining improved particle stabilization during free radical polymerization of heat fusible color toners suitable for use in electrophotographic copiers and printers, and wherein dispersants are avoided. A need also exists for the stabilization of colored toners which exhibit low melting behavior, including a low melting core $Tg<55°$ C., and a low melting polymeric shell $Tg<130°$ C. without particle agglomeration or coalescence during free radical polymerization thereby enabling lower fusing temperatures, and wherein organic methyl cellulose or hydroxylatemethyl cellulose emulsifiers are selected. A further need exists for dry toners with an average mean diameter of from about 5 microns to about 15 microns and a narrow geometric size distribution of less than 1.5, and preferably 1.3 to about 1.4 without the need for micronization or classification. There is a further need for colored toner particles with clean, dirt free surfaces which aid in narrowing the size distribution (reduction of fines of less than 1 micron in an embodiment) and assist to narrow the triboelectric charging distribution of the developer. Additionally, there is a need for toners and processes of preparation thereof for decreasing and/or eliminating the generation of fine particles. Also, there is a need for encapsulated colored toners wherein a minimum amount of surfactant or emulsifier is selected to generate toner size particles. There is a further need for encapsulated colored toners for an improved process that will eliminate the grafting or incorporation of poly(vinylalcohol) into the shell at elevated temperatures. Also, there is a need for encapsulated colored toners wherein a higher loading of the organic phase into the aqueous phase can be accomplished. Further, there is a need for encapsulated toners wherein images with excellent resolution and no background development are obtained in an embodiment of the present invention. Additionally, there is a need for encapsulated toners, including colored toners wherein an emulsifier when incorporated into the shell does not substantially effect the melt flow properties and the fusing properties of the toner. There is a further need for encapsulated colored toners that enable shell flexibility and fusibility through the addition of polyether backbone prepolymers. Also, there is a need for the reduction of the tribo range for a series of differently pigmented toner samples to enable pigment passivation when charged against numerous carriers in an embodiment of the present invention.

SUMMARY OF THE INVENTION

It is an object of the present invention to provide encapsulated heat fusible toner compositions with many of the advantages illustrated herein.

In another object of the present invention there are provided encapsulated colored heat fusible toner compositions comprised of a core of polymer resin binder, pigments and/or dyes and thereover a shell prepared, for example, by interfacial polymerization.

Another object of the present invention is the provision of encapsulated heat fusible toners wherein agglomeration or coalescence is eliminated at elevated temperatures in some embodiments, or minimized in other embodiments without the addition of a dispersant prior to free radical polymerization.

Further, another object of the present invention is the provision of encapsulated heat fusible toners wherein toner fines are eliminated in some embodiments, or minimized in other embodiments.

Additionally, another object of the present invention is the provision of encapsulated heat fusible encapsulated toners with extended shelf life without substantially any modifications of the characteristics thereof.

Also, another object of the present invention is the provision of color, that is black, and other colored encapsulated heat fusible toners.

Another object of the present invention is the provision of encapsulated heat fusible toners that can be selected for imaging processes, including processes wherein single component development and two component development systems, both magnetic and nonmagnetic, and/or ionographic processes, are selected.

In another object of the present invention there are provided simple and economical processes for black, and colored heat fusible toner compositions formulated by an interfacial/free radical polymerization process in which the shell formation (interfacial polymerization), core formation (free radical polymerization), and resulting material properties, may be independently controlled in some embodiments.

Another object of the present invention resides in simple and economical processes for black, and colored heat fusible toner compositions with heat fusible shells formulated by an interfacial/free radical polymerization process.

It is another object of the present invention to provide a process for preparing improved heat fusible color toners suitable for use in electrophotographic copiers and printers.

Another object of the present invention resides in the provision of colored toners that exhibit low melting temperatures to enable low energy fusing of the developed images to substrates.

Additionally, another object of the present invention is the provision of encapsulated heat fusible colored toners that posses mean particle diameters of from about 5 microns to about 15 microns without the need for micronization or classification.

Another object of the present invention is the provision of colored heat fusible encapsulated toners with a narrow size distribution, preferably with a GSD of 1.4 or less without the need for micronization and classification.

In another object of the present invention there is provided a reduction in the amount of emulsifier needed to generate the desired particle size and particle size distribution during the dispersion step Another object of the present invention is the provision of colored heat fusible toner particles with clean dirt free surfaces.

Moreover, another object of the present invention is the provision of colored toner particles with heat fusible shells ($Tg < 130°$ C.) that do not agglomerate or coalesce at elevated temperatures during free radical polymerization.

Also, another object of the present invention is the elimination of grafting or shell incorporation of poly(vinylalcohol) on the colored heat fusible toner particle surface.

Additionally, another object of the present invention is the provision of encapsulated colored heat fusible toners with improved particle stabilization ability thus enabling an increased loading of the organic phase into the aqueous phase.

Another object of the present invention is the provision of encapsulated colored heat fusible toner compositions comprising improved shell flexibility and fusibility through the addition of polyether backbone prepolymers.

Yet another object of the present invention is to provide encapsulated colored heat fusible compositions having highly stabilized pigment dispersions with a wide choice of pigments for known highlight and process color.

Still another object of the present invention is to provide encapsulated colored heat fusible toner compositions wherein the triboelectric characteristics of the toners may be controlled and predetermined.

Another object of the present invention resides in the provision of encapsulated colored heat fusible toner compositions that enable colored toner particles to posses triboelectric charging characteristics independent of the pigment selected as a colorant.

Another object of the present invention resides in the provision of encapsulated colored heat fusible toners wherein toners of different colors can attain the same or similar equilibrium levels of triboelectric charge when charged against the same carrier, and the equilibrium level of charge can be varied by changing the carrier and charge at the same rate; and which toners posses similar admix characteristics.

Another object of the present invention resides in the provision of encapsulated colored heat fusible toner compositions wherein the triboelectric charge of the toner is primarily determined by the shell materials which may or may not include the emulsifier and/or by charge control additive components.

An additional object of the present invention is the provision of encapsulated colored heat fusible toner compositions which enable the narrowing of the triboelectric charge range for various pigmented toner particles thus enabling pigment passivation and the elimination or minimization of the influence of the pigment on the triboelectric charging level against numerous carriers.

It is another object of the present invention which resides in the encapsulated colored heat fusible toner compositions wherein the toner color can be modified without affecting the triboelectric charge of the toner.

These and other objects of the present invention are accomplished by the provision of toners and more specifically encapsulated toners. In one embodiment of the present invention there are provided encapsulated toners with a core and a polymeric shell thereover. Specifically, in one embodiment there are provided in accordance with the present invention encapsulated toners comprised of a core comprised of a preformed polymer and/or monomers, a free radical initiator which initiates the free radical polymerization of the core monomers when heated, pigment and/or dye particles, and wherein the core monomer mixture is dispersed into an emulsifier solution, and subsequently encapsulated by a polymeric shell followed by core polymerization at elevated temperatures via free radical polymerization, and wherein the emulsifier or surfactant is comprised of an organic methyl cellulose, hydroxylated methylcellulose components or mixtures thereof, such as Tylose available from Fluka Inc. of Canada or Methocel available from Dow Chemical.

In an embodiment of the present invention there are provided encapsulated toners comprised of a core preformed polymer and/or monomer or monomers, which are subsequently polymerized; pigment, dye, or mixtures thereof; an emulsifier, especially an organic methylcellulose, a hydroxylated methylcellulose, or mixtures thereof; or wherein the aforementioned emulsifiers can be selected together with other emulsifiers such as poly(vinyl alcohol); which core is encapsulated within a polymeric shell preferably by interfacial polymerization.

DETAILED DESCRIPTION OF THE INVENTION

The toners of the present invention can be prepared in an embodiment thereof by, for example, microencapsulation processes, wherein, for example, a thin heat fusible polymeric shell having a relatively low glass transition temperature of from about 70° C. to about 130° C. is generated by an interfacial condensation polymerization process at room temperature, around a colored pigmented or dyed core material with a lower glass transition temperature of less than 55° C., and wherein the core includes an emulsifier as indicated herein. The organic pigmented monomer phase containing the organic shell component can be dispersed into an aqueous solution of the emulsifying agent such as methylhydroxyethyl cellulose derivatives available from Fluka Inc. of Canada as Tylose, and especially Tylose 93800, other methylcellulose derivatives such as Methocel available from Dow Chemical, mixtures of emulsifiers, and the like as indicated herein.

In one embodiment, with the process of the present invention wherein microencapsulation is selected, there can be obtained a thin heat fusible polymeric shell with a relatively low glass transition temperature of from about 70° C. to about 130° C. and wherein interfacial condensation polymerization processes are selected, which processes can be accomplished at room temperature. Interfacial polymerization is accomplished in some embodiments of the present invention around a colored, pigmented or dyed core material containing, for example, components with low glass transistion temperatures of, for example, less than 55° C. wherein this pigmented organic low Tg core material is dispersed into an aqueous solution of a hydroxyethylmethyl cellulose material commercially available from Fluka Inc. as Tylose to form an oil-in-water dispersion which subsequently undergoes interfacial polymerization. After shell formation, the core monomers undergo free radical polymerization at elevated temperatures of, for example, 85° C. for an effective period of time of, for example, about 18 hours without particle agglomeration and coalescence, for example.

The encapsulated toners of the present invention can be prepared in one embodiment of the present invention by providing a preformed polymer, such as a copolymer comprised of about 52 percent by weight of styrene and 48 percent by weight of n-butyl methacrylate, and a flushed pigment, such as Lithol Scarlet, in a copolymer resin comprised of about 65 percent by weight of styrene and about 35 percent by weight of n-butyl methacrylate and monomer or monomers, such as styrene and n-butyl methacrylate or stearyl methacrylate in a 50:50 ratio; forming an organic phase with initiators and an organic shell component, such as an isocyanate or an acid chloride; dispersing the aforementioned organic phase into a surfactant emulsifier solution; such as those commercially available from Fluka Inc. as Tylose, and Methocel available from Dow Chemical, and the like as illustrated herein; adding to the resulting mixture an aqueous shell component such as a diamine; effecting interfacial polymerization; and subsequently effecting free radical polymerization.

Further, in accordance with the present invention there are provided processes for black and colored encapsulated toner compositions, which process comprises mixing with from about 10 to about 55 percent by weight of water, from about 60 to about 100 percent by weight of a core monomer in a core monomer/polymer mixture including acrylates, methacrylate, and the like such as butyl acrylate, lauryl methacrylate, n-butyl methacrylate hexyl methacrylate, 2-ethylhexyl methacrylate, stearyl methacrylate propyl acrylate, benzyl acrylate, pentyl acrylate, hexyl acrylate, 2-ethylhexyl acrylate cyclohexyl acrylate, dodecyl acrylate, ethoxy propyl acrylate, heptyl acrylate, isobutyl acrylate, methyl butyl acrylate, m-tolyl acrylate, dodecyl styrene, hexylmethyl styrene, nonyl styrene, tetradecyl styrene, $\alpha$-methyl styrene or other substantially equivalent vinyl monomers, and combinations of vinyl monomers with an azo type free radical initiator, such as azoisobutyronitrile, azodimethylvaleronitrile, azobiscyclohexanenitrile, 2-methylbutyronitrile or mixtures thereof, a peroxide type free radical initiators such as benzoyl peroxide, lauroyl peroxide and mixtures thereof, and the like; and pigment particles, including colored organic pigments or dyes, in an amount of from about 1 to about 15 percent by weight of the toner; magnetites, colored magnetites, or carbon blacks in an amount of from about 5 to about 70 percent by weight of the toner; or other similar solid inert materials of a particle size of from about submicron, for example, less than 1 micron to about 5 microns; adding on organic soluble shell comonomer such as isocyanates including toluene diisocyanate, meta-tetramethylxylene diisocyanate (m-TMXD1), trimethylhexamethylene diisocyanate (TMD1), hexane diisocyanate (HD1), diisocyanate prepolymers which are polyether based liquid urethane prepolymer such as the Adiprene series available from DuPont; XPS and XPH series which are toluene diisocyanate terminated polyethylene oxide prepolymers available from Air Product; sebacoyl chloride, adipic acid, toluene bischloroformate, hexanedisulfonic acid, and optionally adding a shell crosslinking agent such as Desmodur RF (Bayer); and dispersing the above-mentioned organic pigmented core monomer material containing the organic shell component into an aqueous emulsifier solution comprised of Tylose 93800, a hydroxyethylmethyl cellulose available from Fluka, 64620 Methocel MC, a methyl cellulose, 64605 Methocel MC, a hydroxypropylmethyl cellulose, 64655 Methocel 60 HG, a methyl cellulose, Methocel E5 Premium, a hydroxypropylmethyl cellulose, all available from Dow Chemical; a Tylose emulsifier hydroxyethylmethyl cellulose, available from Fluka Inc., mixtures thereof in some embodiments, and the like; and subsequently accomplishing by the addition of a water soluble shell comonomer such as diethylene triamine, 1,3-cyclohexane-bis(methylamine), 2-methylpentamethylene diamine hexane diamine, hexamethylenediamine, bisphenol A or any other water soluble copolycondensation coreactant to the aforementioned formed suspension; accomplishing an interfacial polymerization at the interface of the aforementioned mixture; and thereafter affecting a free radical polymerization by heating the resulting suspension and allowing the disassociation of chemical initiator to free radicals and initiation of free radical polymerization by the reaction with core monomer(s).

Illustrative examples of core monomers present in an effective amount of, for example, from about 60 to about 99 percent by weight of the core monomer/polymer mixture include acrylates, methacrylates, diolefins, and the like. Specific examples of core monomers are butyl acrylate, butyl methacrylate, lauryl methacrylate, hexyl methacrylate, hexyl acrylate, 2-ethylhexyl methacrylate, stearyl methacrylate styrene, cyclohexyl acrylate, dodecyl acrylate, ethoxypropyl acrylate, 2-ethylhexyl acrylate heptyl acrylate, isobutyl acrylate, methylbutyl acrylate, m-tolyl acrylate, dodecyl styrene, hexylmethyl styrene, nonyl styrene, tetradecyl styrene, α-methyl styrene, and other known vinyl monomers, reference for example U.S. Pat. No. 4,298,672, the disclosure of which is totally incorporated herein by reference, polylaurylmethacrylate, mixtures thereof; and the like. These monomers may be present alone or as mixtures of monomers to form copolymers. The monomers may also be present in conjunction with preformed polymers, thus polymerization of the core monomer or monomers results in a polymer blend, which may be both a compatible blend, wherein the polymers are miscible and form a uniform, homogeneous mixture, or an incompatible blend, wherein one polymer is present in discrete regions or domains within the other polymer. Examples of additional suitable preformed polymer usually present in an amount of from about 0 percent to about 40 percent of the core include styrene-butadiene copolymers, styrene-acrylate and styrene-methacylate copolymers, ethylene-vinylacetate copolymers, isobutylene-isoprene copolymers and the like. Generally, various effective core monomer or monomers up to, for example, 25 may be selected for the core including styrene acrylates, styrene methacrylates, styrene butadienes, particularly with a high percentage of styrene, that is for example from about 75 to about 95 weight percent of styrene, polyesters, other similar known monomers, and the like.

In one specific embodiment of the present invention, the encapsulated toner is formulated by an interfacial/-free radical polymerization process in which the shell formation and the core formation are controlled independently. Thus, for example, the core materials selected for the toner composition are blended together, followed by encapsulation of these core materials within a polymeric material. The encapsulation process generally takes place by means of an interfacial polymerization reaction, and the core monomer polymerization process is generally accomplished by means of a free radical reaction. More specifically, the process includes the steps of preparing a core by mixing a blend of a core monomer or monomers, one or more free radical polymerization initiators, a pigment or pigments or dyes, a first shell monomer, and, optionally, a core polymer or polymers; forming an organic liquid phase which is dispersed into an aqueous emulsifier such as a methyl cellulose or hydroxyethylmethyl cellulose phase containing a water soluble surfactant or emulsifier to form an oil in water suspension; the addition of a water soluble second shell monomer during constant agitation, and subjecting the mixture to an interfacial polymerization at room temperature.

After the interfacial polymerization is complete and without further addition of any other component, the free radical polymerization of the core monomers within the encapsulated core is effected by increasing the temperature of the aforementioned formed suspension, thereby enabling the initiator to initiate polymerization of the core monomers and resulting in a toner composition comprising a polymeric core containing dispersed pigment, dye, or mixtures thereof encapsulated by polymeric shell. Free radical polymerization of the core monomers generally is at a temperature of from about 50° C. to about 130° C., and preferably from about 60° C. to about 120° C., for a period of from about 8 hours to about 24 hours. The resulting toner material is then washed to remove the stabilizing materials and subsequently dried, preferably utilizing the known spray drying technique. Further details regarding encapsulation by interfacial/free radical polymerization are illustrated in U.S. Pat. No. 4,727,011, the disclosure of which is totally incorporated herein by reference.

With respect to the polymeric core material, preformed polymers may be included as a component of the core as indicated herein. These polymers are compatible with and readily soluble in the core monomers. Examples of suitable polymers include polymers of the monomers illustrated hereafter as suitable core monomers, as well as copolymers of these monomers, such as styrene-butadiene copolymers, styrene-acrylate and styrene-methacrylate copolymers, ethylene-vinylacetate copolymers, isobutylene-isoprene copolymers, and the like.

In addition, a monomer or monomers may be present in the core as illustrated herein during the particle formation step, and subsequently these components can be polymerized in a free radical polymerization process after the shell has been formed by an interfacial polymerization process. Typical specific core monomers are as indicated herein in some instances including styrene, α-methylstyrene, vinyl toluene, n-alkyl methacrylates, n-alkyl acrylates, branched alkyl methacrylates, branched alkyl-acrylates, chlorinated olefins, butadiene, styrene-butadiene oligomers, ethylene-vinyl acetate oligomers, isobutylene-isoprene copolymers with residual double bonds where the weight-average molecular weight ($M_w$) is from about 5,000 to about 20,000 vinylphenolic materials, alkoxy alkoxy alkyl acrylates, alkoxy alkoxy alkyl methacrylates, cyano alkyl acrylates and methacrylates, alkoxy alkyl acrylates and methacrylates, methyl vinyl ether, maleic anhydride, lauryl methacrylate, stearyl methacrylate, isobutyl methacrylate, 2-ethylhexyl methacrylate, styrene butadiene, Pliolites, and the like. These monomers may be present alone or as mixtures of monomers to form copolymers. The monomers may also be present in conjunction with preformed polymers, thus subsequent polymerization of the core monomer results in a polymer blend, which may be both a compatible blend, wherein the polymers are miscible and form a uniform, homogeneous mixture, or an incompatible blend, wherein one polymer is present in discrete regions or domains within the other polymer. In particular, a "flush" of desired organic pigment in a preformed polymer, for example Hostaperm Pink E in a copolymer resin comprised of about 65 percent by weight of styrene and about 35 percent by weight of n-butyl methacrylate, can be mixed with styrene and/or acrylate monomers to form the core material, and these monomers can be subsequently polymerized after shell formation to produce the fully polymerized core in which the dispersion of pigment is extremely uniform. For the process of the present invention, the different colored toners need not contain the same core monomers or polymers since the charging characteristics of the toners are determined by the shell material.

Waxes or wax blends may also be added to the core in effective amounts of, for example, from about 0.5 percent by weight to about 20 percent by weight of the core to improve the low melting properties and/or release properties of the toner. Specific examples of waxes include candelilla, bees wax, sugar cane wax, carnuba wax, paraffin wax and other similar waxes, particularly those with a melting point of about 60° C.

Typical suitable colored pigments may be selected for the toners and processes of the present invention provided, for example, that they are unreactive with the components employed to form the shell in an interfacial polymerization process and that they do not substantially interfere with the free radical polymerization of the core monomer or monomers. Pigment examples are Violet Toner VT-8015 (Paul Uhlich), Normandy Magenta RD-2400 (Paul Uhlich), Paliogen Violet 5100 (BASF), Paliogen Violet 5890 (BASF), Permanent Violet VT2645 (Paul Uhlich), Heliogen Green L8730 (BASF), Argyle Green XP-111-S (Paul Uhlich), Brilliant Green Toner GR 0991 (Paul Uhlich), Lithol Scarlet D3700 (BASF), Toluidine Red (Aldrich), Scarlet for Thermoplast NSD PS PA (Ugine Kuhlmann of Canada), E. D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), Heliogen Blue L6900, L7020 (BASF), Heliogen Blue K6902, K6910 (BASF), Heliogen Blue D6840, D7080 (BASF), Sudan Blue OS (BASF), Neopen Blue FF4012 (BASF), PV Fast Blue B2G01 (American Hoechst), Irgalite Blue BCA (Ciba-Geigy), Paliogen Blue 6470 (BASF), Sudan III (red orange) (Matheson, Coleman, Bell), Sudan II (orange) (Matheson, Coleman, Bell), Sudan IV (orange) (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Novoperm Yellow FGL (Hoechst), Permanent Yellow YE 0305 (Paul Uhlich), Lumogen Yellow D0790 (BASF), Suco-Gelb L1250 (BASF), Suco-Yellow D1355 (BASF), Sico Fast Yellow D1355, D1351 (BASF), Hostaperm Pink E (American Hoechst), Fanal Pink D4830 (BASF), Cinquasia Magenta (DuPont), Paliogen Black L0084 (BASF), Pigment Black K801 (BASF), and carbon blacks such as Regal 330® (Cabot), Carbon Black 5250 and Carbon Black 5750 (Columbian Chemicals Company); magnetites; color magnetites; red, green, blue, brown, Heliogen Blue L6900, D6840, D7080, D7020, Pylam Oil Blue and Pylam Oil Yellow, Pigment Blue 1 available from Paul Uhlich & Company Inc., Pigment Violet 1, Pigment Red 48, Lemon Chrome Yellow DCC 1026, E.D. Toluidine Red and Bon Red C available from Dominion Color Corporation Ltd., Toronto, Ont., Novaperm Yellow FGL, Hostaperm Pink E from Hoechst, Cinquasia Magenta available from E.I. DuPont de Nemours & Company, Oil Red 2144 available from Passaic Color and Chemical, Fanal Pink, Lithol Scarlet, Neopen Blue, Luna Yellow, and the like, which pigments are preferably flushed into a polymer such as a styrene-n-butyl methacrylate. Generally, colored pigments that can be selected are cyan, magenta, or yellow pigments, and mixtures thereof. Examples of magenta materials that may be selected as pigments include, for example, 2,9-dimethyl-substituted quinacridone and anthraquinone dye identified in the Color Index as CI 60710, CI Dispersed Red 15, diazo dye identified in the Color Index as CI 26050, CI Solvent Red 19, and the like. Illustrative examples of cyan materials that may be used as pigments include copper tetra-4-(octadecyl sulfonamido) phthalocyanine, X-copper phthalocyanine pigment listed in the Color Index as CI 74160, CI Pigment Blue, and Anthrathrene Blue, identified in the color index as CI 69810, Special Blue X-2137, and the like; while illustrative examples of yellow pigments that may be selected are diarylide yellow 3,3-dichlorobenzidene acetoacetanilides, a monoazo pigment identified in the color index as CI 12700, CI Solvent Yellow 16, a nitrophenyl amine sulfonamide identified in the Color Index as Foron Yellow SE/GLN, CI Dispersed Yellow 33 2,5-dimethoxy-4sulfonanilide phenylazo-4'-chloro-2,5-dimethoxy acetoacetanilide, and Permanent Yellow FGL. The aforementioned pigments are incorporated into the encapsulated toner compositions in various suitable effective amounts providing the objectives of the present invention are achieved. In one embodiment, these colored pigment particles are present in the toner composition in an amount of from about 1 percent by weight to about 15 percent by weight calculated on the weight of the dry toner. Colored magnetites, such as mixtures of Mapico Black, and cyan components may also be used as pigments.

Various suitable free radical initiators may be employed, especially when the core is prepared by a free radical polymerization, subsequent to the interfacial polymerization reaction that forms the toner shell provided that the 10 hour half-life of the initiator is less than about 120° C., and preferably less than about 90° C. Suitable free radical initiators include azo type initiators, such as 2,2'-azobis(isobutyronitrile), 2,2'-azobis(2,4-dimethylvaleronitrile), 2,2'-azobis(cyclohexanenitrile), 2,2'-azobis-(2-methylbutyronitrile), 2,2'-azobis(2,4-dimethyl-4-methoxyvaleronitrile), mixtures thereof, and the like. Additional free radical initiators include peroxide type initiators such as benzoyl peroxide, lauroyl peroxide and 2,5-dimethyl-2,5-bis(2-ethylhexanoylperoxy)hexane, Lupersol 256® (Pennwalt), and mixtures thereof, or any combination thereof. Typically the initiator is present in the core material being activated at temperatures of from about 50° C. to about 65° C. The low temperature initiator is generally present in an effective amount of, for example, from about 0.5 to about 6 percent by weight of the core monomers, and preferably from about 2 to about 4 percent by weight of the core monomers. Optionally, a high temperature initiator may also be present in the core material being activated at temperatures of over 65° C. The high temperature initiator may be present in effective amounts of, for example, from 0 to about 2 percent by weight of the core monomers, and preferably from about 0.5 to about 1.25 percent by weight of the core monomers.

Suitable shell monomers are usually selected from monomers wherein the number of chemical reacting groups per molecule is two or more. The number of reacting groups per molecule is referred to as the chemical functionality. An organic soluble shell monomer, which has a functionality of 2 or more, reacts with an aqueous soluble shell monomer, which has a functionality of 2 or more, via interfacial polymerization to generate the shell polymer in an embodiment of the present invention. Examples of organic soluble shell monomers are sebacoyl chloride, terephthaloyl chloride, phthaloyl chloride, isophthaloyl chloride, azeloyl chloride, glutaryl chloride, adipoly chloride and hexamethylene diisocyanate purchased from Fluka; 4,4'-dicyclohexylmethane diisocyanate (Desmodur W), and a 80:20 mixture of 2,4- and 2,6-toluene diisocyanate (TDI) purchased from Mobay Chemical Corporation; trans-1,4-cyclohexane diisocyanate purchased from Aldrich, meta-tetramethylxylene diisocyanate (m-TMXDI) from Cyanamid, trimethylhexamethylene diisocyanate (TMDI) purchased from Nuodex Canada and 4,4'-methyldiphenyl diisocyanate (Isonate 125M or MDI) purchased from The Upjohn Company. Examples of crosslinking organic soluble shell monomers, which have a functionality greater than 2, are 1,3,5-benzenetricarboxylic acid chloride purchased from Aldrich; Isonate 143L (liquid MDI based on 4,4'-methyldiphenyl diisocyanate) purchased from The Upjohn Company; and tris(isocyanatophenyl) thiophosphate (Desmodur RF) purchased from Mobay Chemical Corporation. Examples of monomers soluble in aqueous media and with a functionality of 2 include 1,6-hexanediamine, 1,4-bis(3-aminopropyl)piperazine, 2-methylpiperazine, m-xylene-$\alpha,\alpha'$-diamine, 1,8-diamino-$\rho$-menthane, 3,3'-diamino-N-methyldipropylamine and 1,3-cyclohexanebis(methylamine) purchased from Aldrich; 1,4-diaminocyclohexane and 2-methylpentanediamine (Dytek A) purchased from DuPont; 1,2-diaminocyclohexane, 1,3-diaminopropane, 1,4-diaminobutane, 2,5-dimethylpiperazine and piperazine purchased from Fluka; fluorine-containing 1,2-diaminobenzenes purchased from PCR Incorporated; and N,N'-dimethylethylenediamine purchased from Alfa. Other aqueous soluble shell monomers having a functionality greater than 2 are diethylenetriamine and bis(3-aminopropyl)amine obtained from Fluka and tris(2-aminoethyl)amine (TREN-HP) purchased from W.R. Grace Company, and the like.

More than one organic phase monomer can be used to react with more than one aqueous phase monomer. Although formation of the shell entails reaction in an embodiment between at least two shell monomers, one soluble in organic phase and one soluble in aqueous phase, as many as 5 or more monomers soluble in the organic phase and as many as 5 monomers soluble in aqueous phase can be reacted to form the shell. In some preferred instances, 2 monomers soluble in the organic phase and 2 monomers soluble in aqueous phase can be reacted to form the shell.

Another class of shell monomers, which can be selected in the aqueous phase or the organic phase as minor shell components, is functionalized prepolymers. Prepolymers or macromers are long chain polymeric materials which usually have low mechanical integrity and low molecular weights, such as weight-average molecular weights of less than 10,000, but have functional groups on each end of the molecule that react with the shell monomers and can be incorporated into the shell. Examples of such materials that can be selected in the organic phase are isocyanate prepolymers such as Adiprene L-83 and L-167 from DuPont, XPS and XPH from Air Products and the like. The class of Jeffamine materials such as Jeffamine ED-6000, ED-900, D-4000, C-346, DU-700 and EDR-148 from Texaco Chemical Company are aqueous prepolymers which can be incorporated into the shell as the aqueous soluble monomer and the like.

The toner compositions in an embodiment of the present invention generally comprise from about 1 to about 15 percent by weight, and preferably from about 3 to about 10 percent by weight, of the pigment or pigments or dyes, from about 5 to about 50 percent by weight, and preferably from about 7 to about 25 percent by weight, of the polymeric shell, and from about 35 to about 94 percent by weight, and preferably from about 65 to about 90 percent by weight, of the core monomers, polymers and emulsifiers. Within the polymeric shell, the molar ratio of the organic soluble monomer to the aqueous soluble monomer is from about 1:1 to about 1:4, and preferably from about 1:1 to about 1:1.5. Within the mixture of core monomers and polymers, the preformed polymers are present in an amount of from 0 to about 40 percent by weight, preferably from about 0 to about 25 percent by weight, of the monomer/polymer mixture, and the monomers are present in an amount of from about 60 to about 100 percent by weight, preferably from about 75 to about 100 percent by weight, of the monomer/polymer mixture.

An example of a process of the present invention for the preparation of color toner compositions comprises:

(1) preparing a core component comprising (a) selected pigment particles, such as Hostaperm Pink E, in an amount of about 7 percent by weight of the toner, wherein the pigment is flushed into a resin comprising a styrene/n-butyl methacrylate copolymer (about 65 percent styrene and about 35 percent n-butyl methacrylate), which resin is present in an amount about equal to the amount (by weight) of the pigment particles;

(b) an additional preformed polymer, for example a styrene-n-butyl methacrylate copolymer (about 52 percent by weight of styrene and about 48 percent by weight of n-butyl methacrylate) present in an amount such that the total percent weight of this preformed polymer plus the polymer into which the pigment has been flushed is about 20 percent by weight of the core monomer/polymer mixture component of the toner;

(c) a core monomer or mixture of monomers, present in an amount of about 80 percent by weight, of the core monomer/polymer mixture component of the toner, wherein the total amount of monomers plus preformed polymers is about 73 percent by weight of the toner;

(d) an initiator or initiators, present in an amount of from about 0.5 to about 6 percent by weight of the core monomer, and preferably from about 2 to about 4 percent by weight of the core monomer, for a low temperature reacting initiator, and from about 0 to about 2 percent by weight of the core monomer, and preferably from about 0.5 to about 1.25 percent by weight of the core monomer, for a higher temperature reacting initiator; and (e) an organic shell monomer dissolved in the core monomers present in an amount of about 10 percent by weight of the toner composition;

(2) dispersing the resulting homogeneous mixture into a water phase containing an effective amount of surfactant or emulsifier such as Tylose 93800 and, optionally, a base and/or an antifoaming component such as an aliphatic alcohol such as 2-decanol together with optional surfactants, such as cationic embiphillic or nonionic materials; fluroinated hydrocarbon surfactants such as Fluorad Fa-1706, Zonyl FSA, Zonyl FSN, and the like;

(3) adding a water soluble second shell component in an amount of about 10 percent by weight of the toner to the mixture while agitating the dispersed core component and organic soluble shell component of the toner in the stabilizing aqueous phase at room temperature, thus effecting interfacial polymerization;

(4) after about 2 hours of constant agitation at room temperature, increasing the temperature of the suspension to a temperature of from about 50° C. to about 130° C. and preferably from about 60° C. to about 120° C. for about 8 hours to about 24 hours, and preferably from about 8 hours to about 18 hours, thereby effecting free radical polymerization of the core monomers;

(5) thereafter washing the toner thus formed to remove the emulsifying materials; and (6) subsequently drying the final toner product, preferably employing a spray drying process.

Shell polymers suitable for use with the present invention include those mentioned herein and which may be formed in an interfacial polymerization process. Typical shell polymers include polyureas, polyurethanes, polyesters, thermotropic liquid crystalline polyesters, polycarbonates, polyamides, polysulfones, and the like, or mixtures of these polymers such as poly(urea-urethanes), poly(ester-amides), and the like, which can be formed in a polycondensation reaction of suitably terminated prepolymers or macromers with different condensation monomers. For example, a preformed alcohol terminated urethane prepolymer can be copolymerized with a diacyl halide to form a poly(ester-urethane) in an interfacial reaction, or an amine terminated amide prepolymer can be copolymerized with a diisocyanate to produce a poly(urea-amide) copolymer. Epoxy monomers or oligomers such as Epikote 819 can also be added in amounts of from about 0.01 percent to about 30 percent to copolymerize into the shell as strengthening agents. Various polyfunctional shell monomers, such as triamines, triisocyanates, and triols can be employed in small quantities of from about 0.01 percent to about 30 percent as crosslinking agents to introduce rigidity and strength into the shells. Shell polymers can also be formed by the reaction of aliphatic diisocyanates, such as meta-tetramethylene diisocyanate and a polyamine, reference for example the U.S. Pat. No. 5,037,716 mentioned herein.

A surfactant or emulsifier, such as the Tylose materials or the Methocels, can generally be added to disperse the hydrophobic particles in the form of toner size droplets in the aqueous medium and for stabilization of these droplets against coalescence or agglomeration prior to shell formation, during shell formation and also during core monomer polymerization. The types of emulsifiers employed usually enable complete particle stabilization and also control the particles size and size distribution of the components include Tylose 93800, a hydroxyethylmethyl cellulose, hydroxy propyl methyl cellulose, other hydroxyalkylmethyl celluloses methyl cellulose materials, and the like. These emulsifiers can also be used alone or in combination with other emulsifers as co-emulsifiers such as poly(vinylalcohol), polyethylene sulfonic acid salt, polyvinylsulfate ester salt, carboxylated poly(vinylalcohol), water soluble alkoxylated diamines or similar water soluble block copolymers, gum arabic, albumin, polyacrylic acid salt, block copolymers of propylene oxide and ethylene oxide, gelatin, phthaled gelatin, succinated gelatin salts of alginic acid and the like. In addition, water soluble inorganic salts may also be employed as co-emulsifiers to stabilize the dispersion, such as trisodium polyphosphate, tricalcium polyphosphate and the like. The aforementioned emulsifier is present in an effective amount as illustrated herein, and with regard to the coemulsifier, various suitable effective mixes thereof are selected, which mixtures contain an effective amount of the emulsifiers illustrated herein such as hydroxy ethyl methyl cellulose and a second or plurality of other emulsifiers such as polyvinyl alcohol wherein the first emulsifier is present in an amount, for example, of from about 1 to about 25, and from about 1 to about 10 weight percent; and the second or plurality of emulsifiers in total are present in an amount of from 0.1 to 25 weight percent and preferably from about 5 to about 15 weight percent.

Examples of interfacial polymerization processes suitable for formation of the polymeric shell are illustrated in U.S. Pat. Nos. 4,000,087 and 4,307,169, the disclosures of which are totally incorporated herein by reference.

Surface additives can be selected for the toners of the present invention including, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate Aerosil R972, Aerosil R974 or Aerosil R812.

Surface charge control agents or additives can be added to the toner particles by numerous methods. These components can be incorporated into the shell by the addition thereof to the surfactant or emulsifier phase, thus during interfacial polymerization of the shell the surface charge control agent is physically incorporated into the shell. This process is particularly suitable when one portion of the charge control agent is functionalized with a group such as an amine so that the charge control agent reacts as a minor aqueous shell component and is chemically incorporated into the shell. During the interfacial polymerization, the surface charge control agent diffuses toward the outer boundary of the shell and is thus located on the shell surface. Examples of surface charge control agents suitable for incorporation into the shell material include fumed or colloidal silicas such as the Aerosils ®, aluminas, talc powders, metal salts, metal salts of fatty acids such as zinc stearate, cetyl pyridinium salts, distearyl dimethyl ammonium methyl sulfate, and the like. Preferably the charge control agents are colorless compounds so as not to interfere with the purity of color of the toners. Generally, the surface charge enhancing additives when incorporated as a component of the shell are present in an effective amount of, for example, from about 0.1 percent to about 20 percent by weight of the aqueous shell component.

Also, surface charge control agents can be blended onto the surface of the toner particles subsequent, for example, to particle formation. After particle formation and just prior to spray drying, the surface charge control agent can be added to the aqueous suspension of the washed particles, therefore during the spray drying process the charge control agent adheres to the shell surface. Surface charge control additives can also be dry blended onto the dry toner surface in a tumbling/shearing apparatus such as a Lodige blender or a Lab Master II blender manufactured by Lightnin. Examples of surface charge control additives suitable for addition to the toner surface include fumed silicas or fumed metal oxides onto the surface of which have been deposited charge enhancing additives such as cetyl pyridinium chloride, distearyl dimethyl ammonium methyl sulfate, potassium tetraphenyl borate and the like. These surface treated silicas or metal oxides are typically treated with 5 to 25 percent of the charge enhancing agent. The surface charging agents that can be physically absorbed to the toner surface by mechanical means are generally present in an amount of from about 0.01 percent to about 15 percent by weight of the toner and preferably from about 0.1 percent to about 5 percent by weight of the toner.

In a two component development system, toner in about 2 to about 3 percent toner concentration for example, is blended with carrier to, for example, enable a triboelectric charge between the toner and carrier. The latitude of tribo is determined by, for example, the selected shell materials and the choice of carrier. Through frictional contact between the carrier and the toner, an electrostatic charge sufficient for development of an electrostatic latent image is produced on the toner and maintained at a predetermined level. Examples of suitable carriers include a carrier comprising a bare steel core of, for example, approximately 12 microns in diameter; a carrier comprising a core such as a ferrite spray coated with a thin layer of a polymeric material, 0.1 to 1 weight percent, such as a methyl terpolymer comprising about 81 percent of methyl methacrylate, about 14 percent of styrene and about 5 percent of vinyl triethoxysilane; a carrier comprising a nonround, oxidized steel shot core coated with a thin layer of a polymer comprising about 65 percent of trifluorochloroethylene and about 35 percent of vinyl chloride blended with carbon black; a carrier comprising a steel shot core coated with polyvinylidene fluoride; a carrier comprising about 35 percent by weight of polyvinylidene fluoride and about 65 percent by weight of polymethylmethacrylate; and a carrier comprising a ferrite core coated with a methyl terpolymer comprising about 81 percent of methyl methacrylate, about 14 percent of styrene and about 5 percent of vinyltriethoxysilane blended with carbon black. Other carriers may be employed to achieve the desired triboelectric charge on the toner, reference U.S. Pat. Nos. 4,937,166 and 4,935,326, the disclosures of which are totally incorporated herein by reference.

With further reference to the present invention, formation of the toner particles by an interfacial polymerization reaction followed by a free radical polymerization of the core monomers results in toner particles having a highly smooth toner particle morphology. The core can be polymerized subsequent to shell formation, and the viscosity of the pigmented core composition is low enough to allow the dispersion of the core in the aqueous surfactant solution during the primary particle generation step. In most forms of microencapsulation, the core consists of a preformed polymer dissolved in a solvent prior to dispersion in the aqueuos phase, as illustrated in, for example, U.S. Pat. Nos. 4,476,211; 4,476,212 and 4,610,945, to achieve a sufficiently low viscosity to allow efficient dispersion of both the pigments in the core polymer and dispersion of the organic phase into the aqueous phase. The presence of a solvent in the core, however, may cause several problems. When the solvent is high boiling and not removed on drying of the toner, the imaged toners may have very poor smear properties, and there may also be odor problems and environmental problems associated therewith, for example, chlorinated solvents, which can also be possible carcinogens. The solvent recovery step is expensive, and the manufacturing equipment for particle isolation generally must be explosion proof, which also adds to the process cost. If the solvent for the core polymer is low boiling and can be removed on drying of the toner, then since the particle size is fixed by the interfacial polymerization process while the solvent is still present, the toner particles will collapse to form very wrinkled particles or collapsed disc-like particles if the shell is sufficiently flexible. This effect generally results in very poor flow properties of the toner, and generates complications in the particle preparation process necessitating recovery of the solvent. Alternatively, if the particles have shells which are very rigid, upon escape of the solvent, large voids will be apparent inside the toner capsule resulting in a low bulk density of the toner and a lack of image density for a fixed volume of toner developed. In some instances, escaping solvent can cause the toner shells to explode, or may create holes in the shell on drying. These difficulties are avoided or minimized with the toners of the present invention by, for example, employing a process as described herein, wherein the polymeric core is formed by a free radical polymerization subsequent to the formation of the shell.

In addition, the shell of the microencapsulated toner prepared according to the aforementioned process has a high enough glass transition temperature, that is greater than about 60° C., in some or many embodiments of the present invention to provide adequate blocking properties and excellent mechanical properties for the resulting toner particles. Thus, there is no constraint upon the major polymer component of the toner, that is for the core polymer to have a glass transition temperature as high as 55° C. to 60° C., as is the situation with conventional melt-blended toners. Core polymerizations by free radical mechanisms may be designed to produce low melting and low energy fusing core polymers that fuse and melt at temperatures of from about −60° C. to about 60° C., which considerably widens the choice of free radical polymerizable monomers suitable for use in toner compositions of this type as compared to the choice available for toners prepared by melt-blending methods.

The following examples are being submitted to further define various species of the present invention. These examples are intended to be illustrative only and are not intended to limit the scope of the present invention. Also, parts and percentages are by weight unless otherwise indicated.

EXAMPLE I

Four colored toners comprising a styrene-butadiene resin and respectively, Neopen Blue pigment, Lithol Scarlet pigment, Hostaperm Pink E pigment, and Fanal Pink pigment were prepared as follows with a Davo Twin-Screw Extruder. Two K-tron volumetric screw feeders were employed to feed a styrene/butadiene copolymer resin comprising about 87 percent by weight of styrene and about 13 percent by weight of butadiene, and pigment to produce 6 percent loading of pigment in the polymer resin at a combined feed rate of 20 grams per minute into the extruder. The first control zone was set at 120° C. and the other two zones and die were set at 130° C. The screw speed of the extruder was adjusted to 60 rpm prior to feeding in the materials. The extrudate was subsequently air cooled and chopped into small pieces by a Berlyn Pelletizer, and the pelletized material was ground into a smaller particle size of 850 microns by a Model J Fitzmill and then a micronizer further reduced the toner to a desired particle size of 11.4 microns±1 micron.

Four developers were then prepared by mixing 3 grams of each of the above prepared form toners with 97 grams of a carrier comprising a ferrite core spray coated with a thin layer of a methyl terpolymer comprising 81 percent methyl methacrylate, 14 percent styrene, and 5 percent vinyl triethoxysilane. When measuring the triboelectric charging characteristics of the toners, the toner and carrier samples were conditioned overnight in a Tappi Room wherein the room was kept at a constant temperature of 22° C. and constant humidity of 50 percent RH. For each of the four different pigmented toners, 100 grams of developer were prepared by weighing 3 grams of toner and 97 grams of carrier into a 250 milliliter glass bottle and agitating the developer on a paint shaker for 10 minutes. The tribo data was measured with a known Faraday Cage tribo blow-off apparatus using 1.0 to 1.5 grams of the mixed developer.

As a result of contact with the carrier, the toners became triboelectrically charged. The toner containing Neopen Blue pigment exhibited a triboelectric charge (tribo) of −55 microcoulombs per gram; the toner containing Lithol Scarlet pigment exhibited a tribo of −40 microcoulombs per gram; the toner containing Hostaperm Pink E pigment exhibited a tribo of −21.8 microcoulombs per gram; and the toner containing Fanal Pink pigment exhibited a tribo of +7.9 microcoulombs per gram. The tribo values for the four toners containing four different pigments thus ranged over 62.9 tribo units.

EXAMPLE II

Six colored heat fusible microencapsulated toners were prepared by the following procedure. Into a 250 milliliter polyethylene bottle were added 52.56 grams of a styrene monomer (Polysciences Inc.), 35.04 grams of a stearyl methacrylate monomer (Scientific Polymer Products), 9.07 grams of a copolymer comprising about 52 percent by weight of styrene and 48 percent by weight of n-butyl methacrylate, and 23.33 grams of a mixture of Lithol Scarlet NBD-3755 pigment (BASF) flushed into a styrene/n-butyl methacrylate copolymer comprising 65 percent by weight of styrene and 35 percent by weight of n-butyl methacrylate, wherein the pigment to copolymer ratio is 45/55 percent by weight. With the aid of a Burrell wrist shaker, the polymer and pigment were dispersed into the monomers overnight (16 hours). Subsequently, into five separate additional 250 milliliter polyethylene bottles were added 52.56 grams of styrene monomer to each bottle (Polysciences Inc.) and 35.04 grams of stearyl methacrylate monomer (Scientific Polymer Products) to each bottle. Additionally, to one bottle were added 11.4 grams of a styrene/n-butyl methacrylate copolymer comprising about 52 percent by weight of styrene and 48 percent by weight of n-butyl methacrylate, and 21.0 grams of a mixture of Hostaperm Pink E (Hoechst) predispersed into a styrene/n-butyl methacrylate copolymer comprising 65 percent by weight of styrene and 35 percent by weight of n-butyl methacrylate; wherein the pigment to copolymer ratio is 50/50. To another bottle were added 6.15 grams of a styrene/n-butyl methacrylate copolymer comprising about 52 percent by weight of styrene and 48 percent by weight of n-butyl methacrylate, and 26.25 grams of a mixture of Heliogen Blue G (BASF) flushed into a styrene/n-butyl methacrylate copolymer comprising 65 percent by weight of styrene and 35 percent by weight of n-butyl methacrylate; wherein the pigment to copolymer ratio is 40/60. Into a third additional bottle were added 6.15 grams of a styrene/n-butyl methacrylate copolymer comprising about 52 percent by weight of styrene and 48 percent by weight of n-butyl methacrylate, and 26.25 grams of a mixture of Luna Yellow NBD-1277 (BASF) flushed into a styrene/n-butyl methacrylate copolymer comprising 65 percent by weight of styrene and 35 percent by weight of n-butyl methacrylate, wherein the pigment to copolymer ratio is 40/60. Into a fourth additional bottle were added 6.79 grams of a styrene/n-butyl methacrylate copolymer comprising about 52 percent by weight of styrene and 48 percent by weight of n-butyl methacrylate, and 25.61 grams of a mixture of Sicofast Yellow AAOT (BASF) flushed into a styrene/n-butyl methacrylate copolymer comprising 65 percent by weight of styrene and 35 percent by weight of n-butyl methacrylate, wherein the pigment to copolymer ratio is 41/59. Into a fifth additional bottle were added 6.15 grams of a styrene/n-butyl methacrylate copolymer comprising about 52 percent by weight of styrene and 48 percent by weight of n-butyl methacrylate, and 26.25 grams of a mixture of Fanal Pink D4830 (BASF) flushed into a styrene/n-butyl methacrylate copolymer comprising 65 percent by weight of styrene and 35 percent by weight of n-butyl methacrylate, wherein the pigment to copolymer ratio is 40/60. The five pigmented monomer/polymer mixtures were placed on a Burrell wrist shaker for 24 to 48 hours to disperse the polymer and pigment into the monomer resulting in toner compositions comprising 7 percent by weight of pigment, 20 percent by weight of shell and 73 percent by weight of core which was composed of 20 percent preformed polymer and 80 percent monomers. The remaining portion of the synthetic procedure was repeated for all 6 different pigmented cores. Once the pigmented monomer solution was homogeneous, into the mixture was dispersed 3.50 grams of 2,2'-azobis(2,4-dimethylvaleronitrile) (Polysciences Inc.) and 0.876 gram of 2,2'-azobis(2-methylbutyronitrile) (DuPont) with the aid of the Burrell wrist shaker for 10 to 15 minutes. Immediately prior to the dispersion of the pigmented core into the aqueous phase metatetramethylxylene diisocyanate m-TMXDI (Cyanamid), 19.0 grams, was added to the core and shaken by hand. Into a stainless steel 2 liter beaker containing 0.75 percent of Tylose 93800 solution, a hydroxyethylmethyl cellulose (Fluka), 600 milliliters and potassium iodide, 99 percent, (Aldrich) 1.0 gram, was dispersed the above pigmented monomer solution with a Brinkmann PT45/80 homogenizer and a PTA-35/4G probe at 9,000 rpm for 1 minute. This was repeated for all of the above toners (6). The dispersion (this process was repeated for the preparation of each toner) was performed in a cold water bath at a temperature of 15° C. This mixture was transferred into a 2 liter glass reactor equipped with a mechanical stirrer and an oil bath underneath the reactor. While stirring the solution vigorously, an aqueous solution of 2-methylpentamethylene diamine, Dytek A (DuPont), 11.0 grams, and distilled water, 50 milliliters, was poured into the reactor and the mixture was stirred for 2 hours at room temperature. During this time, the interfacial polymerization occured to form a heat fusible aliphatic-like polyurea shell of low Tg (<130° C.). While still stirring, the volume of the reaction mixture was increased with the addition of 300 milliliters of distilled water. The temperature was then increased to 85° C. for 18 hours to polymerize the monomeric material via free radical polymerization to form the remaining polymeric core. The solution was cooled to room temperature and was washed 10 times by gravity settling the particles and decanting off the supernatant layer. The resulting encapsulated toners were screened wet through a 150 micron sieve prior to spray drying using the Yamato-Ohkawara spray dryer model DL-41.

A seventh toner was prepared for comparative purposes with the same composition and by the above method, except that it contained no pigment.

The total yield after spray drying of the Lithol Scarlet NBD-3755 toner was 65.0 percent with the average particle size being 14.0 microns with a GSD $[(d_{84}/d_{16})^{\frac{1}{2}}]$ of 1.38 as measured by a Multisizer Coulter Counter. The Hostaperm Pink E pigmented toner was produced with a 45.6 percent yield with the average particle size being 14.7 microns with a GSD of 1.36. The Heliogen Blue G pigmented toner was produced with a 61.2 percent yield with the average particle size being 12.9 microns with a GSD of 1.40. The total yield after spray drying of the Luna Yellow NBD-1277 pigmented toner was 60.3 percent with the average particle size being 11.9 microns with a GSD of 1.67. The Sicofast Yellow AAOT pigmented toner was produced with a 36.1 percent yield with the average particle size being 8.2 microns with a GSD of 1.33. The Fanal Pink D4830 pigmented toner was produced with a 47.5 percent yield with the average particle size being 13.2 microns with a GSD of 1.32. The total yield after spray drying of the nonpigmented sample was 62.2 percent with the average particle size being 11.8 microns with a GSD of 1.34 as determined on a Multisizer Coulter Counter.

The thermal properties of the prepared toner particles were measured on the Shimadzu Melt Flow Tester Model CFT-500A showing the glass transition temperature Tg, a softening temperature Ts, an initial flowing temperature $T_{f1}$, an additional flowing temperature, where approximately half of the material has flown through the 1 millimeter orifice $T_{f2}$, and a final flowing temperature, where all of the sample has flown through the die, $T_{f3}$. The benchmark toner comprised of 88 weight percent of styrene/n-butyl methacrylate (58/42) copolymer, 10 weight percent of carbon black, and 2 weight percent of cetyl pyridinium chloride, has the following thermal properties also determined on the Shimadzu Flowtester; Tg=55° C., Ts=85° C., $T_{f1}$=105° C., $T_{f2}$=126° C. and $T_{f3}$=135° C. For the Lithol Scarlet NBD-3755 pigmented sample had Tg=40° C., Ts=93° C., $T_{f1}$=115° C., $T_{f2}$=131° C. and $T_{f3}$=142° C. and the Hostaperm Pink E pigmented toner had the following thermal properties Tg=40° C., Ts=95° C., $T_{f1}$=143° C., $T_{f2}$=153° C. and $T_{f3}$=160° C. For the Heliogen Blue G pigmented toner the thermal properties were as follows Tg=35° C., Ts=95° C., $T_{f1}$=121° C., $T_{f2}$=138° C. and $T_{f3}$=145° C. and for the Luna Yellow NBD-1277 pigmented toner the thermal properties were Tg=45° C., Ts=90° C., $T_{f1}$=140° C., $T_{f2}$=153° C. and $T_{f3}$=160° C. For the Sicofast Yellow AAOT pigmented sample the thermal properties were as follows Tg=42° C., Ts=95° C., $T_{f1}$=120° C., $T_{f2}$=136° C. and $T_{f3}$=144° C. The thermal properties for the Fanal Pink D4830 pigmented sample were Tg=40° C., Ts=90° C., $T_{f1}$=145° C., $T_{f2}$=156° C. and $T_{f3}$=160° C. and for the nonpigmented sample the thermal properties were Tg=45° C., Ts=107° C., $T_{f1}$=145° C., $T_{f2}$=157° C. and $T_{f3}$=165° C. The Scanning Electron Microscopy (SEM) micrographs showed discrete spherical heat fusible particles that were not aggregated or coalesced together for the above prepared 6 toners.

When measuring the tribo charging characteristics of the above prepared 7 toners, each of the toner and carrier samples were conditioned overnight in a Tappi Room wherein the room was retained at a constant temperature of 22° C. and constant humidity of 50 percent RH. Seven developers were then prepared by mixing 2 grams of each of the above prepared toners with 98 grams of a carrier comprising a bare steel core of approximately 120 microns in diameter. The toner and carrier in each instance were weighted into a 250 milliliter glass bottle and agitated on a roll mill for 15 minutes. The tribo data was measured on a Faraday Cage blow-off apparatus, as was the situation for all the Examples that follow unless otherwise noted, using 1.0 to 1.5 grams of the developer. As a result of contact and agitation with the carrier, the toners became triboelectrically charged. The toner containing Lithol Scarlet pigment exhibited a triboelectric charge (tribo) of +1.6 microcoulombs per gram; the toner containing Hostaperm Pink E pigment exhibited a tribo of +3.5 microcoulombs per gram; the toner containing Heliogen Blue G pigment exhibited a tribo of +2.3 microcoulombs per gram; the toner containing Fanal Pink pigment exhibited a tribo of +2.4 microcoulombs per gram; the toner containing Sicofast Yellow pigment exhibited a tribo of +5.8 microcoulombs per gram; the toner containing Luna Yellow pigment exhibited a tribo of +4.0 microcoulombs per gram and the unpigmented toner exhibited a tribo of +2.2 microcoulombs per gram. The tribo values for the six different pigmented toners and also the unpigmented toners covered a tribo range of 4.2 tribo units, which indicates a significant decrease in the tribo range as compared to the tribo range of 62.9 units reported in Example I which was prepared by a melt blending process. The Scanning Electron Microscopy (SEM) micrographs evidenced for the prepared toners (6) discrete spherical heat fusible particles that were not stuck together. In a two component development system where the developer is composed of carrier beads and toner particles, the above prepared toner particles will fuse to a paper substrate in each instance with normal heat assisted fusing conditions and under low fuser roll pressure of only 400 psi.

With the above prepared toner particles, the triboelectric charge was measured against four different carriers, which four carriers were comprised of a ferrite core spray coated with a thin layer of a methyl terpolymer comprising about 81 percent methyl methacrylate, about 14 percent stryene and about 5 percent vinyl triethoxysilane; a carrier composed of a steel shot core powder coated with polyvinylidene fluoride; a carrier composed of a steel shot core coated with a polymer blend of about 40 percent by weight of polyvinylidene fluoride and about 60 percent by weight of poly(methyl methacrylate); and a carrier composed of a nonround, oxidized steel shot core coated with a thin layer of a polymer comprising about 65 percent by weight of trifluorochloroethylene and about 35 percent by weight of vinyl chloride blended with carbon black. For each colored developer, the sample was conditioned overnight in a Tappi Room wherein the room remained at a constant temperature of 22° C. and at a constant humidity of 50 percent RH. Each developer was prepared as indicated above including mixing 2 grams of each of the toners with 98 grams of carrier. The seven prepared different colored developers each containing 2 grams of toner and 98 grams of a carrier where the carrier is comprised of a ferrite core spray coated with a thick layer (1.0 percent coating weight) of a methyl terpolymer comprising about 81 percent methyl methacrylate, about 14 percent styrene and about 5 percent vinyl triethoxysilane when agitated with Lithol Scarlet pigmented toner, exhibited a toner tribo charge of +1.3 microcoulombs per gram; the toner containing Hostaperm Pink E pigment exhibited a tribo charge of +1.6 microcoulombs per gram; the toner containing Heliogen Blue G pigment exhibited a tribo of +2.3 microcoulombs per gram; the toner containing Fanal Pink pigment exhibited a tribo of +3.9 microcoulombs per gram; the toner containing Sicofast Yellow pigment exhibited a tribo of +3.7 microcoulombs per gram, the toner containing Luna Yellow pigment exhibited a tribo of +5.1 microcoulombs per gram and the toner containing no pigment exhibited a tribo charge of +4.6 microcoulombs per gram. The tribo values for the six different pigmented toners and the unpigmented toners encompassed a tribo range of 3.8 tribo units.

Five different developers, each containing 2 grams of toner and 98 grams of a third carrier composed of a steel shot core powder coated with polyvinylidene fluoride when agitated with Hostaperm Pink E pigmented toner, exhibited a tribo charge of +12.4 microcoulombs per gram. The toner containing Heliogen Blue pigment exhibited a tribo of +14.3 microcoulombs per gram; the toner containing Sicofast Yellow pigment exhibited a tribo of +12.4 microcoulombs per gram; the toner containing Luna Yellow pigment exhibited a tribo of +14.6 microcoulombs per gram and the toner containing no pigment exhibited a tribo charge of +7.6 microcoulombs per gram. The tribo values for the four different pigmented toners and the unpigmented toner encompassed a tribo range of 7.0 tribo units when charged against the above third carrier.

Six different developers, each containing 2 grams of toner and 98 grams of a fourth carrier, are composed of a steel shot core coated with a polymer blend of about 40 percent by weight of polyvinylidene fluoride, and about 60 percent by weight of poly(methyl methacrylate), when agitated with Lithol Scarlet pigmented toner, exhibited a tribo charge of +9.2 microcoulombs per gram. The toner containing Hostaperm Pink E pigment exhibited a tribo charge of +12.1 microcoulombs per gram; the toner containing Heliogen Blue G pigment exhibited a tribo charge of +6.4 microcoulombs per gram; the toner containing Sicofast Yellow pigment exhibited a tribo of +10.0 microcoulombs per gram; the toner containing Luna Yellow pigment exhibited a tribo charge of +8.7 microcoulombs per gram and the toner containing no pigment exhibited a tribo of +9.3 microcoulombs per gram. The tribo values for the five different pigmented toners and the unpigmented toner encompassed a tribo range of 5.7 tribo units, which with a fourth carrier indicates a significant decrease in tribo range as compared to Example I which encompassed a tribo range of 62.9 units.

Six different developers, each containing 2 grams of toner and 98 grams of a fifth carrier composed of a nonround, oxidized steel shot core coated with a thin layer of a polymer comprising about 65 percent by weight of trifluorochloroethylene and about 35 percent by weight of vinyl chloride blended with carbon black when agitated with Lithol Scarlet pigmented toner, exhibited a tribo charge of +23.8 microcoulombs per gram. The toner containing Hostaperm Pink E pigment exhibited a tribo of +22.8 microcoulombs per gram; the toner containing Heliogen Blue G pigment exhibited a tribo of +20.7 microcoulombs per gram; the toner containing Fanal Pink pigment exhibited a tribo charge of +21.0 microcoulombs per gram; the toner containing Luna Yellow pigment exhibited a tribo range of +19.0 microcoulombs per gram and the toner containing no pigment exhibited a tribo charge of +21.1 microcoulombs per gram. The tribo values for the five different pigmented toners and the unpigmented toner encompassed a tribo range of 4.8 tribo units, which with a fifth carrier indicates a significant decrease in tribo range as compared to Example I (62.9).

In two component development systems where the developer is composed of the above carrier beads and pigmented toner particles, the toner particles will fuse to a paper substrate under normal heat assisted fusing conditions and with low fuser roll pressure of only 400 psi. The developers and toners were prepared in each instance by substantially repeating the processes illustrated in Example II. The carrier coating weights in each instance were about 1.25 weight percent.

EXAMPLE III

Four colored heat fusible microencapsulated toners were prepared by the following procedure. Into a 250 milliliter polyethylene bottle were added 52.56 grams of a styrene monomer (Polysciences Inc.), 35.04 grams of a stearyl methacrylate monomer (Scientific Polymer Products), 9.07 grams of a copolymer comprising about 52 percent by weight of styrene and 48 percent by weight of n-butyl methacrylate, and 23.33 grams of a mixture of Lithol Scarlet NBD-3755 pigment (BASF) flushed into a styrene/n-butyl methacrylate copolymer comprising 65 percent by weight of styrene and 35 percent by weight of n-butyl methacrylate, wherein the pigment to copolymer ratio is 45/55. With the aid of a Burrell wrist shaker, the polymer and pigment were dispersed into the monomers overnight. Subsequently, into three additional 250 milliliter polyethylene bottles were added 52.56 grams of styrene monomer (Polysciences Inc.) to each bottle and 35.04 grams of stearyl methacrylate monomer (Scientific Polymer Products) to each bottle. Additionally, to one bottle was added 11.4 grams of a styrene/n-butyl methacrylate copolymer comprising about 52 percent by weight of styrene and 48 percent by weight of n-butyl methacrylate, and 21.0 grams of a mixture of Hostaperm Pink E (Hoechst) predispersed into a styrene/n-butyl methacrylate copolymer comprising 65 percent by weight of styrene and 35 percent by weight of n-butyl methacrylate, wherein the pigment to copolymer ratio is 50/50. To another bottle was added 6.15 grams of a styrene/n-butyl methacrylate copolymer comprising about 52 percent by weight of styrene and 48 percent by weight of n-butyl methacrylate, and 26.25 grams of a mixture of Heliogen Blue G (BASF) flushed into a styrene/n-butyl methacrylate copolymer comprising 65 percent by weight of styrene and 35 percent by weight of n-butyl methacrylate, wherein the pigment to copolymer ratio is 40/60. Into a third additional bottle were added 6.15 grams of a styrene/n-butyl methacrylate copolymer comprising about 52 percent by weight of styrene and 48 percent by weight of n-butyl methacrylate, and 26.25 grams of a mixture of Fanal Pink D4830 (BASF) flushed into a styrene/n-butyl methacrylate copolymer comprising 65 percent by weight of styrene and 35 percent by weight of n-butyl methacrylate, wherein the pigment to copolymer ratio is 40/60.

The resulting three pigmented monomer/polymer mixtures were placed on a Burrell wrist shaker for 24 to 48 hours to disperse the polymer and pigment into the monomer resulting in toner compositions comprising 7 percent by weight of pigment, 20 percent by weight of shell and 73 percent by weight of core, which was composed of 20 percent of performed polymer and 80 percent of monomers. Once the pigmented monomer solution was homogeneous, into the above mentioned mixture were dispersed 3.50 grams of 2,2'-azobis(2,4-dimethylvaleronitrile), available from Polysciences Inc., and 0.876 gram of 2,2'-azobis(2-methylbutyronitrile), available from DuPont, with the aid of the Burrell wrist shaker for 10 to 15 minutes. Just before the dispersion of the pigmented core into the aqueous phase meta-tetramethylxylene diisocyanate m-TMXDI (Cyanamid), 18.5 grams were added to the core and shaken by hand. Into a stainless steel 2 liter beaker containing 0.75 percent of Tylose 93800 solution, a hydroxyethylmethylcellulose (Fluka), 600 milliliters, and potassium iodide, 99 percent, (Aldrich), 1.0 gram, was dispersed the above pigmented monomer solution (the process was repeated for the preparation of each toner) with a Brinkmann PT45/80 homogenizer and a PTA-35/4G probe at 9,000 rpm for 1 minute. The dispersion was performed in a cold water bath at a temperature of 15° C. This mixture was transferred into a 2 liter glass reactor equipped with a mechanical stirrer and an oil bath underneath the reactor. While stirring the solution vigorously, an aqueous solution of 1,3-cyclohexanebis(methylamine) (Aldrich), 11.8 grams, and distilled water, 50 milliliters, was poured into the reactor and the mixture was stirred for 2 hours at room temperature. During this time, the interfacial polymerization occurred to form a heat fusible aliphatic-like polyurea shell of low Tg (<130° C.). While stirring, the volume of the reaction mixture was increased with the addition of 300 milliliters of distilled water. The temperature was then increased to 85° C. for 18 hours to polymerize the monomeric material via free radical polymerization to form the remaining polymeric core. The solution cooled to room temperature and was washed 10 times by gravity settling the particles and decanting off the supernatant layer. The resulting toner particles were screened wet through a 150 micron sieve prior to spray drying using the Yamato-Ohkawara spray dryer model DL-41. A fifth toner was prepared with the same composition and by the same method except that it contained no pigment.

The total yield after spray drying of the Lithol Scarlet NBD-3755 toner was 62.4 percent with the average particle size being 13.6 microns with a GSD $[(d_{84}/d_{16})^{\frac{1}{2}}]$ of 1.38 as measured by a Multisizer Coulter Counter. The Hostaperm Pink E pigmented toner was produced with a 24.5 percent yield and the average particle size was 15.6 microns with a GSD of 1.36. The Heliogen Blue G pigmented toner was produced with a 60.0 percent yield with the average particle size being 13.2 microns with a GSD of 1.38. The total yield after spray drying the Fanal Pink D4830 pigmented toner was 40.1 percent with an average particle size of 13.0 microns and a GSD of 1.40. The total yield after spray drying the nonpigmented sample was 44.4 percent with the average particle size being 12.8 microns with a GSD of 1.29 as determined on a Multisizer Coulter Counter.

The thermal properties of the above prepared toner particles were measured on the Shimadzu Melt Flow Tester Model CFT-500A showing the glass transition temperature Tg, a softening temperature Ts, an initial flowing temperature $T_{f1}$, an additional flowing temperature where approximately half of the material has flown through the 1 millimeter orifice $T_{f2}$, and a final flowing temperature where all of the sample has flown through the die, $T_{f3}$. The benchmark toner comprised of 88 weight percent of styrene/n-butyl methacrylate (58/42) copolymer, 10 weight percent of carbon black, and 2 weight percent of cetyl pyridinium chloride has the following thermal properties also determined on the Shimadzu Flowtester Tg=55° C., Ts=85° C., $T_{f1}$=105° C., $T_{f2}$=126° C. and $T_{f3}$=135° C. For the Lithol Scarlet NBD-3755 pigmented sample the Tg<20° C., Ts=73° C., $T_{f1}$=105° C., $T_{f2}$=122° C. and $T_{f3}$=135° C. For the Heliogen Blue G pigmented toner the thermal properties were as follows Tg<20° C., Ts=65° C., $T_{f1}$=85° C., $T_{f2}$=105° C. and $T_{f3}$=115° C. For the Hostaperm Pink E pigmented toner, the thermal properties were Tg<20° C., Ts=65° C., $T_{f1}$=91° C., $T_{f2}$=112° C. and $T_{f3}$=120° C. For the Fanal Pink D4830 pigmented sample, the thermal properties were as follows Tg<20° C., Ts=65° C., $T_{f1}$=90° C., $T_{f2}$=109° C., and $T_{f3}$=120° C. and for the nonpigmented sample the thermal properties were Tg<20° C., Ts=60° C., $T_{f1}$=75° C., $T_{f2}$=98° C. and $T_{f3}$=109° C. The Scanning Electron Microscopy (SEM) micrographs showed discrete spherical heat fusible particles that were not aggregated or coalesced together for the above prepared 5 toners.

When measuring the tribo charging characteristics of the above prepared 5 toners, the toner and carrier samples were conditioned overnight in a Tappi Room wherein the room was retained at a constant temperature of 22° C. and constant humidity of 50 percent RH. Five developers were then prepared by mixing 2 grams of each of the above mentioned 5 toners with 98 grams of a carrier comprising a bare steel core of approximately 120 microns in diameter. The toner and carrier were weighed into a 250 milliliter glass bottle and agitated on a blow-off apparatus using 1.0 to 1.5 grams of the developer. As a result of contact and agitation with the carrier, the toners became triboelectrically charged. The toner containing Lithol Scarlet pigment exhibited a triboelectric charge (tribo) of +4.6 microcoulombs per gram, the toner containing Hostaperm Pink E pigment exhibited a tribo of +0.9 microcoulombs per gram, the toner containing Heliogen Blue G pigment exhibited a tribo level of +5.0 microcoulombs per gram, the toner containing Fanal Pink D4830 pigment exhibited a tribo level of +1.6 microcoulombs per gram and the unpigmented toner sample exhibited a tribo charging level of +5.4 microcoulombs per gram. The tribo values for the four pigmented toners and the unpigmented toner encompassed a tribo range of 4.5 tribo units, which indicates a significant decrease in tribo range compared to the tribo range of 62.9 units reported in comparative Example I. In two component development systems where the developer is composed of carrier beads and toner particles, the prepared toners will fuse to a paper substrate under normal heat assisted fusing conditions and with low fuser roll pressure of only 400 psi in each instance. Coating weight for the carrier coating was 1.25 in each instance.

EXAMPLE IV

Five colored heat fusible microencapsulated toners were prepared by the following procedure. Into a 250 milliliter polyethylene bottle was added 20.1 grams of a styrene monomer (Polysciences Inc.), 46.9 grams of n-butyl methacrylate monomer (Fluka), 6.8 grams of a copolymer comprising about 52 percent by weight of styrene and 48 percent by weight of n-butyl methacrylate, and 18.2 grams of a mixture of Lithol Scarlet NBD-3755 pigment (BASF) flushed into a styrene/n-butyl methacrylate copolymer comprising 65 percent by weight of styrene and 35 percent by weight of n-butyl methacrylate, wherein the pigment to copolymer ratio is 45/55 by weight. With the aid of a Burrell wrist shaker, the polymer and pigment were dispersed into the monomers overnight. Subsequently, into three additional 250 milliliter polyethylene bottles were added 20.1 grams of styrene monomer to each bottle (Polysciences Inc.) and 46.9 grams of n-butyl methacrylate monomer (Fluka) to each bottle. Additionally, to one bottle was added 8.6 grams of a styrene/n-butyl methacrylate copolymer comprising about 52 percent by weight of styrene and 48 percent by weight of n-butyl methacrylate, and 16.4 grams of a mixture of Hostaperm Pink E (Hoechst) predispersed into a styrene/n-butyl methacrylate copolymer comprising 65 percent by weight of styrene and 35 percent by weight of n-butyl methacrylate, wherein the pigment to copolymer ratio is 50/50. To another bottle were added 4.5 grams of a styrene/n-butyl methacrylate copolymer comprising about 52 percent by weight of styrene and 48 percent by weight of n-butyl methacrylate, and 20.5 grams of a mixture of Heliogen Blue G (BASF) flushed into a styrene/n-butyl methacrylate copolymer comprising 65 percent by weight of styrene and 35 percent by weight of n-butyl methacrylate, wherein the pigment to copolymer ratio is 40/60. Into a third additional bottle were added 4.5 grams of a styrene/n-butyl methacrylate copolymer comprising about 52 percent by weight of styrene and 48 percent by weight of n-butyl methacrylate, and 20.5 grams of a mixture of Fanal Pink D4830 (BASF) flushed into a styrene/n-butyl methacrylate copolymer comprising 65 percent by weight of styrene and 35 percent by weight of n-butyl methacrylate, wherein the pigment to copolymer ratio is 40/60. Into a fourth additional bottle were added 5.0 grams of a styrene/n-butyl methacrylate copolymer comprising about 52 percent by weight of styrene and 48 percent by weight of n-butyl methacrylate, and 20.0 grams of a mixture of Sicofast Yellow AAOT (BASF) flushed into a styrene/n-butyl methacrylate copolymer comprising 65 percent by weight of styrene and 35 percent by weight of n-butyl methacrylate, wherein the pigment to copolymer ratio is 41/59.

The four pigmented monomer/polymer mixtures were placed on a Burrell wrist shaker for 24 to 48 hours to disperse the polymer and pigment into the monomer resulting in toner compositions comprising 7 percent by weight of pigment, 20 percent by weight of shell and 73 percent by weight of core which was composed of 20 percent preformed polymer and 80 percent monomers. Once the pigmented monomer solution was homogeneous, into the mixture was dispersed 1.5 grams of 2,2'-azobis(2,4-dimethylvaleronitrile), available from Polysciences Inc. and 1.5 grams of 2,2'-azobisisobutyronitrile, available from Polysciences Inc., with the aid of the Burrell wrist shaker for 10 to 15 minutes. Just before the dispersion of the pigmented core into the aqueous phase, trimethylhexamethylene diisocyanate TMDI (Nuodex Canada Ltd.), 14.2 grams, was added to the core and shaken by hand. Into a stainless steel 2 liter beaker containing 10 percent Tylose 93800 solution, a hydroxyethylmethylcellulose (Fluka), 500 milliliters, and potassium iodide, 99 percent, available from Aldrich, 1.0 gram, was dispersed (this process was repeated for the preparation of all the toners of this Example) the above pigmented monomer solution with a Brinkmann PT45/80 homogenizer and a PTA-35/4G probe at 7,500 rpm for 1 minute. The dispersion was performed in a cold water bath at a temperature of 15° C. This mixture was transferred into a 2 liter glass reactor equipped with a mechanical stirrer and an oil bath underneath the reactor. While stirring the solution vigorously, an aqueous solution of trimethyl-hexamethylenediamine (Nuodex Canada Ltd.), 11.8 grams, and distilled water, 50 milliliters, was poured into the reactor and the mixture was stirred for 2 hours at room temperature. During this time, the interfacial polymerization occurred to form a heat fusible aliphatic-like polyurea shell of low Tg (<130° C.). While still stirring, the volume of the reaction mixture was increased with the addition of 300 milliliters of distilled water. Then the temperature was increased to 85° C. for 18 hours to polymerize the monomeric material via free radical polymerization to form the remaining polymeric core. The solution cooled to room temperature and was washed 10 times by gravity settling the particles and decanting off the supernatant layer. The particles were wet sieved through 150 micron sieve prior to spray drying using the Yamato-Ohkawara spray dryer model DL-41. A sixth toner was prepared for comparative purposes with the same composition and by the same method except that no pigment was present.

The total yield after spray drying of the Lithol Scarlet NBD-3755 toner was 62 percent with the average particle size being 12.6 microns with a GSD $[(d_{84}/d_{16})^{\frac{1}{2}}]$ of 1.43 as measured by a Multisizer Coulter Counter. The Hostaperm Pink E pigmented toner was produced with a 35 percent yield and the average particle size was 14.4 microns with a GSD of 1.49. The Heliogen Blue G pigmented toner was produced with a 54 percent yield with the average particle size being 12.8 microns with a GSD of 1.40. The total yield after spray drying the Fanal Pink D4830 pigmented toner was 45 percent with an average particle size of 16.8 microns and a GSD of 1.44. The total yield after spray drying the Sicofast Yellow AAOT pigmented toner was 52.7 percent with an average particle size of 8.5 microns and a GSD of 1.43. The total yield after spray drying the nonpigmented sample was 53.0 percent.

The thermal properties of the resulting toner particles were measured on the Shimadzu Melt Flow Tester Model CFT-500A showing the glass transition temperature Tg, a softening temperature Ts, an initial flowing temperature $T_{f1}$, an additional flowing temperature where approximately half of the material has flown through the 1 millimeter orifice $T_{f2}$, and a final flowing temperature where all of the sample has flown through the die, $T_{f3}$. The benchmark toner comprised of 88 weight percent of styrene/n-butyl methacrylate (58/42) copolymer, 10 weight percent of carbon black and 2 weight percent of cetyl pyridinium chloride has the following thermal properties also determined on the Shimadzu Flowtester Tg=55° C., Ts=85° C., $T_{f1}$=105° C., $T_{f2}$=126° C. and $T_{f3}$=135° C. For the Lithol Scarlet NBD-3755 pigmented sample the thermal properties were Tg=54° C., Ts=105° C., $T_{f1}$=130° C., $T_{f2}$=157° C. and $T_{f3}$=170° C. For the Heliogen Blue G pigmented toner the thermal properties were as follows Tg=60° C., Ts=100° C., $T_{f1}$=135°

C., $T_{f2}=167°$ C. and $T_{f3}=178°$ C. For the Hostaperm Pink E pigmented toner the thermal properties were Tg=55° C., Ts=112° C., $T_{f1}=138°$ C., $T_{f2}=168°$ C. and $T_{f3}=180°$ C. For the Fanal Pink D4830 pigmented sample, the thermal properties were as follows Tg=60° C., Ts=105° C., $T_{f1}=135°$ C., $T_{f2}=170°$ C., and $T_{f3}=180°$ C. For the Sicofast Yellow AAOT pigmented toner the thermal properties were Tg=54° C., Ts=101° C., $T_{f1}=125°$ C., $T_{f2}=160°$ C. and $T_{f3}=170°$ C. and for the nonpigmented sample the thermal properties were Tg=55° C., Ts=102° C., $T_{f1}=130°$ C., $T_{f2}=165°$ C. and $T_{f3}=175°$ C. The Scanning Electron Microscopy (SEM) micrographs showed discrete spherical heat fusible particles that were not aggregated or coalesced together for all 6 toners.

When measuring the tribo charging characteristics of the toner, the toner and carrier samples were conditioned overnight in a Tappi Room wherein the room remained at a constant temperature of 22° C. and constant humidity of 50 percent RH. Five developers were then prepared by mixing 2 grams of each of the toners with 98 grams of a carrier comprising a bare steel core of approximately 120 microns in diameter. The toner and carrier were placed into a 250 milliliter glass bottle and agitated on a blow-off apparatus using 1.0 to 1.5 grams of the developer. As a result of contact and agitation with the carrier, the toners became triboelectrically charged. The toner containing Lithol Scarlet pigment exhibited a triboelectric charge (tribo) of +2.3 microcoulombs per gram, the toner containing Hostaperm Pink E pigment exhibited a tribo of +2.5 microcoulombs per gram, the toner containing Heliogen Blue G pigment exhibited a tribo level of +4.8 microcoulombs per gram, the toner containing Fanal Pink D4830 pigment exhibited a tribo level of +8.0 microcoulombs per gram, the toner containing Sicofast Yellow pigment exhibited a tribo level of +5.9 microcoulombs per gram and the unpigmented toner sample exhibited a tribo charging level of +2.9 microcoulombs per gram. The tribo values for the five pigmented toners and the unpigmented toner covered a tribo range of 5.7 tribo units. In two component development systems where the developer is composed of the above prepared developers with pigmented toners, the toner particles fused to a paper substrate under normal fusing conditions (about 110° C. to about 180° C., and a silicone roll) and with low fuser roll pressure of only 400 psi.

EXAMPLE V

A colored heat fusible microencapsulated toner was prepared according to the following procedure. Into a 250 milliliter polyethylene bottle was added 55.3 grams of styrene monomer (Polysciences Inc.), 36.1 grams of stearyl methacrylate monomer (Scientific Polymer Products), 17.1 grams of a copolymer comprising about 52 percent by weight of styrene and 48 percent by weight of n-butyl methacrylate, and 10.7 grams of a mixture of Lithol Scarlet NBD-3755 pigment (BASF) flushed into a styrene/n-butyl methacrylate copolymer comprising 65 percent by weight of styrene and 35 percent by weight of n-butyl methacrylate, wherein the pigment to copolymer ratio is 45/55 by weight. With the aid of a Burrell wrist shaker, the polymer and pigment were dispersed into the monomers overnight. The resulting toner composition after polymerization comprises 3.2 percent by weight of pigment, 20 percent by weight of shell and 76.8 percent by weight of core, which was composed of 20 percent preformed polymer and 80 percent monomers. Once the pigmented monomer solution was homogeneous, into the mixture were dispersed 3.69 grams of 2,2'-azobis(2,4-dimethylvaleronitrile), available from Polysciences Inc., and 0.92 gram of 2,2'-azobis(2-methylbutyronitrile), available from DuPont, with the aid of the Burrell wrist shaker for 10 to 15 minutes. Prior to the dispersion of the pigmented core, into the aqueous phase meta-tetramethylxylene diisocyanate, tradename m-TMXDI (Cyanamid), 19.0 grams, was added to the core and shaken by hand. Into a stainless steel 2 liter beaker containing 0.75 percent Tylose 93800 solution, a hydroxyethylmethylcellulose (Fluka), 600 milliliters, and potassium iodide, 99 percent, available from Aldrich, 0.5 gram, was dispersed (this was repeated for the preparation of each toner) the above pigmented monomer solution with a Brinkmann PT45/80 homogenizer and a PTA-35/4G probe at 9,000 rpm for 1 minute. The dispersion was performed in a cold water bath at a temperature of 15° C. This mixture was transferred into a 2 liter glass reactor equipped with a mechanical stirrer and an oil bath underneath the reactor. While stirring the solution vigorously, an aqueous solution of 2-methylpentamethylenediamine, tradename Dytek A, available from DuPont, 11.0 grams, and distilled water, 50 milliliters, was poured into the reactor and the mixture was stirred for 2 hours at room temperature. During this time, the interfacial polymerization occurred to form a heat fusible aliphatic-like polyurea shell of low Tg (<130° C.). While still stirring, the volume of the reaction mixture was increased with the addition of 300 milliliters of distilled water. Then the temperature was increased to 85° C. for 18 hours to polymerize the monomeric material via free radical polymerization to form the remaining polymeric core. The solution cooled to room temperature and was washed 10 times by gravity settling and decanting off the supernatant layer. The resulting toner particles were screened wet through a 150 micron sieve prior to spray drying using the Yamato-Ohkawara spray dryer model DL-41.

Fifty grams of the dried toner particles were placed into a plexiglass dry blending container along with 0.6 gram of Aerosil R974, available from Degussa, and dry blended at a tumbling rate of 30 revolutions per minute with an impeller speed of approximately 3,000 revolutions per minute for 5 minutes on a Lab Mask II Dry Blender by Lightnin. After dry blending, the toner particles were screened dry through a 150 micron sieve.

The total yield after spray drying of the toner was 47.0 percent and the average particle size was 12.8 microns with a GSD of 1.41 as measured by a Multisizer Coulter Counter. The thermal properties of the particles as measured on the Shimadzu Melt Flow Tester were Tg<20° C., Ts=85° C., $T_{f1}=106°$ C., $T_{f2}=117°$ C. and $T_{f3}=126°$ C. The Scanning Electron Microscopy (SEM) micrographs showed discrete spherical heat fusible particles that were not aggregated or coalesced together. The angle of repose of the toner particles without Aerosil R974 was 55 degrees.

After dry blending the Aerosil R974 onto the toner particle surface and dry screening the particles, a total of 43.57 grams or 87 percent of material were recovered. The average particle size was 12.9 microns with a GSD of 1.40. Also, the thermal properties were measured with the added Aerosil present and the Tg<20° C., Ts=80° C., $T_{f1}=105°$ C., $T_{f2}=116°$ C., and $T_{f3}=123°$ C. The angle of repose after dry blending on the Aerosil was 30 degrees.

A developer sample containing 3 percent by weight of the above prepared toner particles and 97 percent carrier beads comprised of a steel shot core powder coated with polyvinylidene fluoride was roll milled for 30 minutes and imaged by cascade development in a xerographic imaging test fixture with an amorphous selenium photoreceptor. The resulting solid area was fused at temperatures from 110° C. to 180° C. with a silicone roll at 11.9 ips and evaluated by the known crease test. The minimum fusing temperature of the toner was 117° C. Cold offset was noted at 110° C. but no hot offset was found at 180° C. for a fusing latitude wider than 63° C.

EXAMPLE VI

A colored heat fusible microencapsulated toner was prepared according to the following procedure. Into a 250 milliliter polyethylene bottle was added 55.3 grams of styrene monomer (Polysciences Inc.), 36.9 grams of stearyl methacrylate monomer (Scientific Polymer Products), 17.1 grams of a copolymer comprising about 52 percent by weight of styrene and 48 percent by weight of n-butyl methacrylate, and 10.7 grams of a mixture of Lithol Scarlet NBD-3755 pigment (BASF) flushed into a styrene/n-butyl methacrylate copolymer comprising 65 percent by weight of styrene and 35 percent by weight of n-butyl methacrylate, wherein the pigment to copolymer ratio is 45/55 by weight. With the aid of a Burrell wrist shaker, the polymer and pigment were dispersed into the monomers overnight. The resulting toner composition after polymerization comprises 3.2 percent by weight of pigment, 20 percent by weight of shell and 76.8 percent by weight of core, which was composed of 20 percent preformed polymer and 80 percent monomers. Once the pigmented monomer solution was homogeneous, into the mixture was dispersed 3.69 grams of 2,2'-azobis(2,4-dimethylvaleronitrile), available from Polysciences Inc., and 0.92 gram of 2,2'-azobis(2-methylbutyronitrile), available from DuPont, with the aid of the Burrell wrist shaker for 10 to 15 minutes. Prior to the dispersion of the pigmented core into the aqueous phase, meta-tetramethylxylene diisocyanate, tradename m-TMXDI (Cyanamid), 18.5 grams, was added to the core and shaken by hand. Into a stainless steel 2 liter beaker containing 0.75 percent Tylose 93800 solution, a hydroxyethylmethylcellulose (Fluka), 600 milliliters, and potassium iodide, 99 percent, (Aldrich), 0.125 gram, was dispersed the above pigmented monomer solution with a Brinkmann PT45/80 homogenizer and a PTA-35/4G probe at 9,000 rpm for 1 minute. The dispersion was performed in a cold water bath at a temperature of 15° C. This mixture was transferred into a 2 liter glass reactor equipped with a mechanical stirrer and an oil bath underneath the reactor. While stirring the solution vigorously, an aqueous solution of 1,3-cyclohexanebis(methylamine), (Aldrich), 11.8 grams, and distilled water, 50 milliliters, was poured into the reactor and the mixture was stirred for 2 hours at room temperature. During this time, the interfacial polymerization occurred to form a heat fusible aliphatic-like polyurea shell of low Tg (<130° C.). While still stirring, the volume of the reaction mixture was increased with the addition of 300 milliliters of distilled water. Then the temperature was increased to 85° C. for 18 hours to polymerize the monomeric material via free radical polymerization to form the remaining polymeric core. The solution cooled to room temperature and was washed 10 times by gravity settling and decanting off the supernatant layer. The particles were screened wet through a 150 micron sieve prior to spray drying using the Yamato-Ohkawara spray dryer model DL-41.

Fifty grams of the resulting dried toner particles were placed into a plexiglass dry blending container along with 0.6 grams of Aerosil R974 (Degussa) and dry blended at a tumbling rate of 30 revolutions per minute with an impeller speed of approximately 3,000 revolutions per minute for 5 minutes on a Lab Mask II Dry Blender by Lightnin. After dry blending the particles were screened dry through a 150 micron sieve.

The total yield after spray drying of the toner was 67.0 percent and the average particle size was 11.6 microns with a GSD of 1.41 as measured by a Multisizer Coulter Counter. The thermal properties of the particles as measured on the Shimadzu Melt Flow Tester were Tg<20° C., Ts=70° C., $T_{f1}$=96° C., $T_{f2}$=114° C. and $T_{f3}$=125° C. The Scanning Electron Microscopy (SEM) micrographs showed discrete spherical heat fusible particles that were not aggregated or coalesced together. The angle of repose of the toner particles without Aerosil R974 was 50 to 55 degrees.

After dry blending the Aerosil R974 onto the toner particle surface and dry screening the particles, a total of 44.49 grams or 89 percent of material were recovered. The angle of repose after dry blending on the Aerosil R974 was 30 degrees.

A developer sample containing 3 percent toner particles and 97 percent carrier beads comprised of a steel shot core powder coated with polyvinylidene fluoride was roll milled for 30 minutes and imaged by cascade development by repeating the procedures of Example V. The resulting solid area was fused at temperatures from 110° C. to 180° C. with a silicone roll at 11.9 ips and evaluated by the known crease test. The minumum fusing temperature of the toner was 133° C. Cold offset was noted for this sample at 120° C. and hot offset was found at 157° C. for a fusing latitude of 37° C.

In each of the above Examples, unless otherwise noted, the carrier polymer coating weight was 1.25 weight percent.

Although the invention has been described with reference to specific preferred embodiments, it is not intended to be limited thereto; rather those skilled in the art will recognize variations and modifications may be made therein which are within the spirit of the present invention and within the scope of the following claims.

What is claimed is:

1. An encapsulated toner composition comprised of a core comprised of a monomer, or monomers which are subsequently polymerized; pigment or dye particles; an emulsifier component comprised of hydroxyethylmethyl cellulose into which the pigmented monomer mixture is dispersed, and wherein the core is encapsulated within a polymeric shell.

2. A toner composition in accordance with claim 1 wherein the polymeric shell is obtained by interfacial polymerization.

3. A toner composition in accordance with claim 1 wherein the shell is comprised of the interfacial polycondensation reaction of a polyfunctional isocyanate and a polyfunctional amine component.

4. A toner composition in accordance with claim 1 wherein the shell is comprised of the interfacial polycondensation reaction of a polyfunctional isocyanate component and a polyfunctional amine component, said isocyanate component being selected from the group consisting of toluene diisocyanate, meta-tetramethylxylene diisocyanate, trimethylhexamethylene diisocyanate, hexane diisocyanate, hexamethylene diisocyanate, 4,4'-dicyclohexylmethane diisocyanate, and 4,4'-methyldiphenyl diisocyanate; and said amine component is selected from the group consisting of 1,6-hexanediamine, 1,4-bis(3-aminopropyl)piperazine, 2-methylpiperazine, m-xylene-$\alpha,\alpha'$-diamine, 1,8-diamino-$\rho$-methane, 3,3'-diamino-N-methyldipropylamine, 1,3-cyclohexanebis(methylamine), 1,4-diaminocyclohexane, 2-methylpentanediamine (Dytek A), 1,2-diaminocyclohexane, 1,3-diaminopropane, 1,4-diaminobutane, 2,5-dimethylpiperazine, piperazine, fluorine-containing 1,2-diaminobenzenes N,N'-dimethylethylenediamine, diethylenetriamine, bis(3-aminopropyl)amine, tris(2-aminoethyl)amine, ethylenediamine, tetramethylenediamine, pentamethylenediamine, hexamethylenediamine, $\rho$-phenylenediamine, m-phenylenediamine, 2-hydroxytrimethylenediamine, and triethylenetetraamine, tetraethylenepentaamine.

5. A toner in accordance with claim 1 wherein the core monomer component is selected from the group consisting of acrylates and methacrylate.

6. A toner composition in accordance with claim 1 wherein the core monomer component is selected from the group consisting of styrene, methylstyrene, vinyl toluene, n-alkyl methacrylates, n-alkyl acrylates, branched alkyl methacrylates, branched alkyl acrylates, chlorinated olefins, butadiene, stryene-butadiene oligomers, ethylene-vinyl acetate oligomers, isobutylene-isoprene copolymers, vinyl-phenolic materials, alkoxy alkoxy alkyl acrylates and methacrylates, cyano alkyl acrylates and methacrylates, alkoxy alkyl acrylates and methacrylates, methyl vinyl ether, maleic anhydride and mixtures thereof.

7. A toner composition in accordance with claim 1 wherein the core polymer component is selected from the group consisting of poly(lauryl methacrylate), poly(dodecyl acrylate), poly(stearyl methacrylate), styrene-lauryl methacrylate copolymer, and poly(dodecyl styrene).

8. A toner composition in accordance with claim 1 wherein the core polymer is selected from the group consisting of styrene-butadiene copolymers, styrene-acrylate copolymers, styrene-methacrylate copolymers, ethylene-vinylacetate copolymers, isobutylene-isoprene copolymers and mixtures thereof.

9. A toner composition in accordance with claim 1 wherein the pigment particles are magnetite, carbon black, mixtures thereof; red, green, blue, cyan, magenta, yellow, or mixtures thereof; or colored organic pigments.

10. A toner in accordance with claim 1 wherein the core monomer or monomers are polymerized by free radical polymerization.

11. A toner composition in accordance with claim 1 wherein free radical polymerization initiators are selected from the group consisting of 2,2'-azobis-(isobutyronitrile), 2,2'-azobis(2,4-dimethylvaleronitrile), 2,2'-azobis(cyclohexanenitrile), 2,2'-azobis(2-methylbutyronitrile), 2,2'-azobis(2,4-dimethyl-4-methoxyvaleronitrile), benzoyl peroxide, lauryl peroxide, 2,5-dimethyl-2,5-bis(2-ethylhexanoylperoxy)hexane, and mixtures thereof.

12. A toner composition in accordance with claim 1 wherein the core monomers are styrene and stearyl methacrylate polymerized via free radical polymerization to form a copolymer; and the shell polymer is formed by the reaction of a meta-tetramethylxylene diisocyanate with the amine monomer 2-methylpentamethylenediamine to form a heat fusible polyurea shell.

13. A toner composition in accordance with claim 1 wherein the core monomers are styrene and stearyl methacrylate polymerized via free radical polymerization to form a copolymer; and the shell polymer is formed by the reaction of a meta-tetramethylxylene diisocyanate and 1,3-cyclohexanebis(methylamine) to form a heat fusible polyurea shell with a glass transition temperature of less than about 130° C.

14. A toner composition in accordance with claim 1 wherein the core monomers are styrene and n-butyl methacrylate polymerized via free radical polymerization to form a copolymer; and the shell is formed by the reaction of a trimethylhexamethylene diisocyanate with trimethylhexamethylenediamine to form a heat fusible polyurea shell with a glass transition temperature of less than about 130° C.

15. A toner composition in accordance with claim 1 wherein the core contains a preformed polymer.

16. A toner composition in accordance with claim 1 wherein the core polymer has a molecular weight distribution ratio $M_w/M_n$ of from about 1.0 to about 4.

17. A toner composition in accordance with claim 1 wherein the pigment is magnetite present in an amount of from between about 30 to about 65 percent of the toner; the core polymer component comprises from between about 10 to about 64 percent of the toner; and the shell materials comprise from between about 6 to about 25 percent of the toner.

18. A toner composition in accordance with claim 17 wherein the core polymer has a number average molecular weight of from about 15,000 to about 100,000.

19. A toner composition in accordance with claim 17 wherein the pigment is a magnetic material selected from the group of metals and metal oxides.

20. A toner composition in accordance with claim 17 wherein the magnetic material is selected from the group consisting of iron, cobalt, nickel, manganese, and alloys thereof.

21. A heat fusible encapsulated colored toner composition comprised of a core comprised of a monomer or monomers which are subsequently polymerized; pigment or dye particles; an emulsifier component comprised of hydroxyethylmethyl cellulose into which the pigmented monomer mixture is dispersed and wherein the core is encapsulated within a polymeric shell.

22. A composition according to claim 1 wherein the ratio of the amount of the core polymeric material to the amount of core monomer or monomers is from about 0:100 to about 40:60.

23. A composition according to claim 1 wherein the core monomers and the polymeric material are present in a total amount of from about 35 to about 94 percent by weight of the toner composition.

24. A composition in accordance with claim 1 wherein the core material includes a wax selected from the group consisting of candelilla, beeswax, sugar cane wax, carnuba wax, paraffin wax and mixtures thereof.

25. A composition in accordance with claim 24 wherein the wax is present in an amount of from about 0.5 percent to about 20 percent by weight of the core.

26. A composition in accordance with claim 1 wherein the polymeric shell is selected from the group consisting of polyureas, polyurethanes, polyesters, thermotropic liquid crystalline polyesters, polycarbonates, polyamides, polysulfones, poly(urea-urethanes), poly(ester-amides), poly(urea-amides), poly(ester-urethane) and mixtures thereof.

27. A composition in accordance with claim 1 wherein the polymeric shell is present in an amount of from about 5 to about 50 percent by weight of the toner.

28. A composition in accordance with claim 1 wherein the surface of the toner contains thereon additives selected from the group consisting of fumed silicas and colloidal silicas.

29. A composition in accordance with claim 22 wherein colloidal silica is selected.

30. A composition in accordance with claim 11 wherein the free radical initiators are present in an amount of from about 0.5 to about 8 percent by weight of the core.

31. An encapsulated toner composition comprised of a core comprised of a monomer, which is subsequently polymerized, a pigment, and an emulsifier component comprised of hydroxyethylmethyl cellulose; and wherein the core components are encapsulated within a polymeric shell.

32. A toner composition in accordance with claim 31 wherein the core is comprised of a mixture of monomers.

33. A toner composition in accordance with claim 32 wherein from about 2 to about 10 monomers are selected.

34. A toner composition in accordance with claim 31 wherein the pigment is selected from the group consisting of carbon black, magnetites, or mixtures thereof.

35. A toner composition in accordance with claim 31 wherein the pigment is selected from the group consisting of red, green, brown, blue, cyan, magenta, yellow or mixtures thereof.

36. A toner composition in accordance with claim 31 wherein the polymeric shell is formulated by an interfacial polymerization reaction.

37. A toner composition in accordance with claim 31 wherein the polymeric shell is formulated by an interfacial polymerization of an isocyanate and an amine.

38. A toner composition in accordance with claim 31 wherein the polymeric shell is selected from the group consisting of a polyester, a polyurea, or a polyurethane.

39. An encapsulated toner composition comprised of a core comprised of a monomer and a preformed polymer, wherein the monomer is subsequently polymerized, a pigment, and an emulsifier component comprised of hydroxyethylmethyl cellulose; and wherein the aforementioned core components are encapsulated within a polymeric shell.

40. A toner composition in accordance with claim 39 wherein the polymer is selected from the group consisting of styrene acrylates, styrene methacrylates, or styrene butadienes.

41. A toner composition in accordance with claim 39 wherein a mixture of monomers is selected.

42. A toner composition in accordance with claim 1 wherein the pigment is carbon black, magnetite or mixtures thereof.

43. A toner composition in accordance with claim 39 wherein the pigment is red, blue, green, brown, cyan, magenta, yellow or mixtures thereof.

44. A toner composition in accordance with claim 39 wherein the core includes dyes.

45. A toner composition in accordance with claim 39 wherein the shell is obtained by interfacial polymerization by a polyfunctional isocyanate and a polyfunctional amine component.

46. A process for the preparation of encapsulated colored toners which comprises preparing a first core material comprising first pigment particles, core monomers, and a free radical initiator; preparing a second core material, which comprises second pigment particles, core monomers, and a free radical initiator, the second pigment particles being of a different color from that of the first pigment particles; dispersing the first and second core materials into an aqueous phase containing an emulsifier of claim 1; encapsulating separately the first core material and the second core material within polymeric shells by interfacial polymerization reactions between at least two shell monomers, of which at least one is soluble in aqueous media and at least one of which is soluble in organic media, wherein the polymeric shell encapsulating the first core material is of substantially the same composition as the polymeric shell encapsulating the second core material; and subsequently polymerizing the first and second core monomers by free radical polymerization, thereby generating two encapsulated toner compositions of different colors with similar triboelectric charging characteristics.

47. A process according to claim 46 wherein the two resulting toner compositions have mean particle diameters of less than 10 microns.

48. A process according to claim 46 wherein the two resulting toner compositions have mean particle diameters of from about 5 to about 8 microns.

49. A process according to claim 46 wherein the core monomers present in the first and second core materials are independently selected from the group consisting of styrene, α-methylstyrene, vinyl toluene, n-alkyl methacrylates, n-alkyl acrylates, branched alkyl methacrylates, branched alkyl acrylates, chlorinated olefins, butadiene, styrene-butadiene oligomers, ethylene-vinyl acetate oligomers, isobutylene-isoprene copolymers, vinyl-phenolic materials, alkoxy alkoxy alkyl acrylates, alkoxy alkoxy alkyl methacrylates, cyano alkyl acrylates and methacrylates, alkoxy alkyl acrylates and methacrylates, methyl vinyl ether, maleic anhydride, and mixtures thereof.

50. A process according to claim 46 wherein the first and second core materials contain up to 5 core monomers.

51. A process according to claim 46 wherein free radical polymerization initiators are selected from the group consisting of 2,2'-azobis(isobutyronitrile), 2,2'-azobis(2,4-dimethylvaleronitrile), 2,2'-azobis(cyclohexanenitrile), 2,2'-azobis-(2-methylbutyronitrile), 2,2'-azobis(2,4-dimethyl-4-methoxyvaleronitrile), benzoyl peroxide, lauryl peroxide, 2,5-dimethyl-2,5-bis(2-ethylhexanoylperoxy)hexane, Lupersol, and mixtures thereof.

52. A process for the preparation of encapsulated toner compositions which comprises:

(1) preparing a core component comprising
  (a) pigment particles wherein the pigment is flushed into a resin comprising a styrene/n-butyl methacrylate copolymer;
  (b) an additional preformed polymer; and
  (c) a core monomer or mixture of monomers;
(2) dispersing the resulting homogeneous mixture into a water phase containing an effective amount of an emulsifier comprised of hydroxyethylmethyl cellulose and, optionally, a base and/or an antifoaming component;

(3) adding the water soluble second shell component to the mixture while agitating the dispersed core component and organic soluble shell component of the toner in the stabilizing aqueous phase at room temperature, thus effecting interfacial polymerization;

(4) increasing the temperature of the suspension to a temperature of from about 50° C. to about 130° C. thereby effecting free radical polymerization of the core monomers;

(5) thereafter washing the toner thus formed to remove the emulsifying materials; and (6) subsequently drying the final toner product.

53. A method of imaging which comprises the formation of a latent image; subsequently developing this image with the encapsulated toner composition of claim 1; thereafter transferring the image to a supporting substrate; and affixing the image thereto.

54. A method of imaging which comprises the formation of a latent image; subsequently developing this image with the encapsulated toner composition of claim 4; thereafter transferring the image to a supporting substrate; and affixing the image thereto.

55. A method of imaging which comprises the formation of a latent image; subsequently developing this image with the encapsulated toner composition of claim 30; thereafter transferring the image to a supporting substrate; and affixing the image thereto.

56. A method of imaging which comprises the formation of a latent image; subsequently developing this image with the encapsulated toner composition of claim 38; thereafter transferring the image to a supporting substrate; and affixing the image thereto.

57. A method of imaging which comprises the formation of a latent image; subsequently developing this image with the encapsulated toner composition of claim 39; thereafter transferring the image to a supporting substrate; and affixing the image thereto.

58. A method of imaging which comprises generating a latent electrostatic image in an electrophotographic imaging apparatus; subsequently developing this image with the toner compositions of claim 1; transferring the image to a supporting substrate; fusing the image at temperature of from about 110° C. to about 180° C.

59. A method of imaging in accordance with claim 58 wherein the core is comprised of a styrene/styrene methacrylate copolymer.

60. A method of imaging in accordance with claim 58 wherein the toner selected contains as the pigment red, blue, green, cyan, magenta, yellow, or mixtures thereof.

61. A method of imaging in accordance with claim 60 wherein the pigment is Lithol Scarlet Red.

62. A method of imaging in accordance with claim 58 wherein the minimum fusing temperature of the toner as selected is from about 130° C. to about 140° C.

63. A method of imaging in accordance with claim 62 wherein the minimum fusing temperature of the toner is 130° C.

64. A method of imaging in accordance with claim 58 wherein the toner has a fusing latitude of from about 35 to about 40° C.

65. A method of imaging in accordance with claim 63 wherein the fusing latitude of the toner is about 37° C.

66. A method of imaging in accordance with claim 58 wherein fusing is accomplished with a silicon roll.

67. A method of imaging in accordance with claim 58 wherein the toner has a minimum fusing temperature of about 117° C.

68. A method of imaging in accordance with claim 58 wherein the toner selected has a fusing latitude of greater than about 63° C.

69. A method of imaging in accordance with claim 58 wherein fixing is accomplished at pressures of from about 80 to about 250 pounds per lineal inch.

70. A toner composition in accordance with claim 1 wherein the toner has a minimum fusing temperature of from about 115° C. to about 140° C.

71. A toner composition in accordance with claim 1 which has a minimum fusing temperature of from about 117° C. to about 133° C.

72. A toner composition in accordance with claim 1 which has a minimum fusing temperature of about 133° C. and a fusing temperature latitude of 37° C.

73. A toner composition in accordance with claim 1 with a minimum fusing temperature of about 117° C. with a fusing latitude of greater than 63° C.

* * * * *